US012180678B2

(12) United States Patent
MacDonald et al.

(10) Patent No.: US 12,180,678 B2
(45) Date of Patent: Dec. 31, 2024

(54) MATERIAL TRANSFER SYSTEM FOR A BODY OF WATER

(71) Applicant: Sea to Sky Energy Solutions Corp., Squamish (CA)

(72) Inventors: Sam MacDonald, Squamish (CA); Lucas Paczek, Squamish (CA); Graham Zell, Squamish (CA); David Halliday, Squamish (CA); Peter Zell, Delta (CA); Brett Robinson, Delta (CA); Simon Szoke, Squamish (CA)

(73) Assignee: Sea to Sky Energy Solutions Corp., Squamish (CA)

( * ) Notice: Subject to any disclaimer, the term of this patent is extended or adjusted under 35 U.S.C. 154(b) by 1286 days.

(21) Appl. No.: 16/858,580

(22) Filed: Apr. 25, 2020

(65) Prior Publication Data

US 2020/0392698 A1 Dec. 17, 2020

Related U.S. Application Data

(60) Provisional application No. 62/860,771, filed on Jun. 12, 2019.

(51) Int. Cl.
*E02F 5/28* (2006.01)
*E02B 8/02* (2006.01)
(Continued)

(52) U.S. Cl.
CPC ..... *E02F 5/285* (2013.01); *E02B 8/026* (2013.01); *E02F 3/8808* (2013.01); *E02F 3/8858* (2013.01); *E02F 3/9212* (2013.01)

(58) Field of Classification Search
CPC ..... E02F 5/8808; E02F 5/8858; E02F 5/9212; E02F 7/005; E02F 5/285; E02B 8/026; E02B 3/023
See application file for complete search history.

(56) References Cited

U.S. PATENT DOCUMENTS 1,451,479 A * 4/1923 Rosell ..... E02F 3/08 37/338
1,777,491 A 10/1930 Harp
(Continued)

FOREIGN PATENT DOCUMENTS

CH 196903 A 4/1938
DE 825527 C 12/1951
(Continued)

OTHER PUBLICATIONS

European Search Report completed on Oct. 20, 2020 in respect of corresponding European Application No. EP 20178959.1.

*Primary Examiner* — Jessica H Lutz
(74) *Attorney, Agent, or Firm* — Nicholas Garner; Oyen Wiggs Green & Mutala LLP

(57) ABSTRACT

There is provided a material transfer system including a reciprocating conveyor which selectively moves in a first direction of movement and a second direction of movement opposite the first direction of movement. The conveyor is configured to promote movement of material in the first direction and inhibit movement of material in the second direction.

There is further provided a material transfer system comprising a first reciprocating conveyor which selectively moves material towards a first location. The system includes a second reciprocating conveyor which overlaps with the first reciprocating conveyor. The second reciprocating conveyor selectively moves material from the first location towards a second location.

There is also provided a material transfer system comprising a passageway having an upstream inlet and a downstream outlet. The passageway may be a conduit, a siphon or chute. The system includes a reciprocating conveyor conveying fluvial material towards the inlet of the passageway.

25 Claims, 29 Drawing Sheets

(51) Int. Cl.
*E02F 3/88* (2006.01)
*E02F 3/92* (2006.01)

(56) References Cited

U.S. PATENT DOCUMENTS 3,464,558 A * 9/1969 Harvanek ..... B07B 13/05 210/159
3,479,089 A * 11/1969 Krutein ..... B65G 63/008 37/312
3,672,725 A 6/1972 Johnson
3,675,348 A * 7/1972 Dane, Jr. ..... E02F 7/005 172/393
3,868,323 A * 2/1975 Fux ..... B01D 21/245 210/527
3,908,291 A * 9/1975 Masuda ..... E21C 50/00 226/186
3,968,579 A * 7/1976 Rossfelder ..... E02F 3/081 114/294
4,010,560 A 3/1977 Diggs
4,226,035 A * 10/1980 Saito ..... E02F 3/081 24/265 EE
4,394,841 A 7/1983 Lundback
4,802,292 A * 2/1989 Masuda ..... E02F 3/885 37/195
5,110,454 A 5/1992 Parker et al.
5,412,884 A 5/1995 Staples et al.
9,816,240 B1 11/2017 Tesvich
10,094,091 B1 10/2018 Tesvich
11,712,029 B1 * 8/2023 Badeaux ..... A01K 61/59 119/213
2017/0314219 A1 11/2017 Bartelt

FOREIGN PATENT DOCUMENTS

FR 1081831 A 12/1954
JP H09144057 A 6/1997
JP 6138029 5/2017

* cited by examiner

MATERIAL TRANSFER SYSTEM FOR A BODY OF WATER

FIELD OF THE INVENTION

The present invention relates to a material transfer system. In particular, the invention relates to a material transfer system for a body of water.

DESCRIPTION OF THE RELATED ART

U.S. Pat. No. 9,816,240 to Tesvish discloses apparatuses, methods, and systems for removing sediment from waterway bottoms and pumping the sediment through pipelines. More particularly, the present invention relates to apparatuses, methods, and systems for sediment control and altering the average effective depth in a section of rivers, streams and channels for maintaining the navigability of waterways and coastal restoration. The apparatus preferably comprises a sediment harvesting platform preferably positioned above a water surface; a sediment suction inlet or sediment sink preferably positioned below the top level of source sediment or within a sand bar including a grating, a sediment pump, a venturi including an auger/propeller, and a water jet; a flow control valve; and a pipeline for pumping sediment. The apparatus may further comprise a sediment conveyor including sediment inlets and a remote controlled pulsing valve. The apparatus may further comprise sensor(s) and a programmable logic controller (PLC). The method of the present invention preferably comprises removing sediment from waterway bottoms with at least one apparatus of the present invention. The system of the present invention preferably comprises a plurality of apparatuses in either series or parallel design for sediment control and altering the average effective depth in a section of a waterway.

U.S. Pat. No. 4,010,560 to Diggs discloses a deep sea mining apparatus and method for mining mineral nodules from the ocean floor. The method includes at least one surface ship and preferably a plurality of nodule harvesting or mining machines supported from the surface ship and resting on the ocean floor for movement along the ocean floor and including nodule gathering devices to gather the mineral nodules as the machine passes over the ocean floor. The nodule harvesting machines include separable, nodule-containing crates which, when full, are lifted to the surface where they are recovered by a surface ship. The crates are emptied of their contents and subsequently returned to the machines on the ocean floor to be refilled. The placement and guidance of the harvesting machines on the ocean floor is controlled by sonar devices and television cameras and the like.

BRIEF SUMMARY OF INVENTION

There is provided, and it is an object to provide, an improved material transfer system for a body of water.

There is accordingly provided a material transfer system according to a first aspect. The system includes a reciprocating conveyor which selectively moves in a first direction of movement and a second direction of movement opposite the first direction of movement. The conveyor is configured to promote movement of material in the first direction and inhibit movement of material in the second direction.

There is also provided a material transfer system according to a second aspect. The system includes a first reciprocating conveyor which selectively moves material towards a first location. The system includes a second reciprocating conveyor which overlaps with the first reciprocating conveyor. The second reciprocating conveyor selectively moves material from the first location towards a second location.

There is further provided a material transfer system according to a third aspect. The system includes a passageway having an upstream inlet and a downstream outlet. The passageway may be a conduit, a siphon or a chute, for example. The system includes a reciprocating conveyor conveying fluvial material towards the inlet of the passageway. The material passes through the passageway thereafter.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
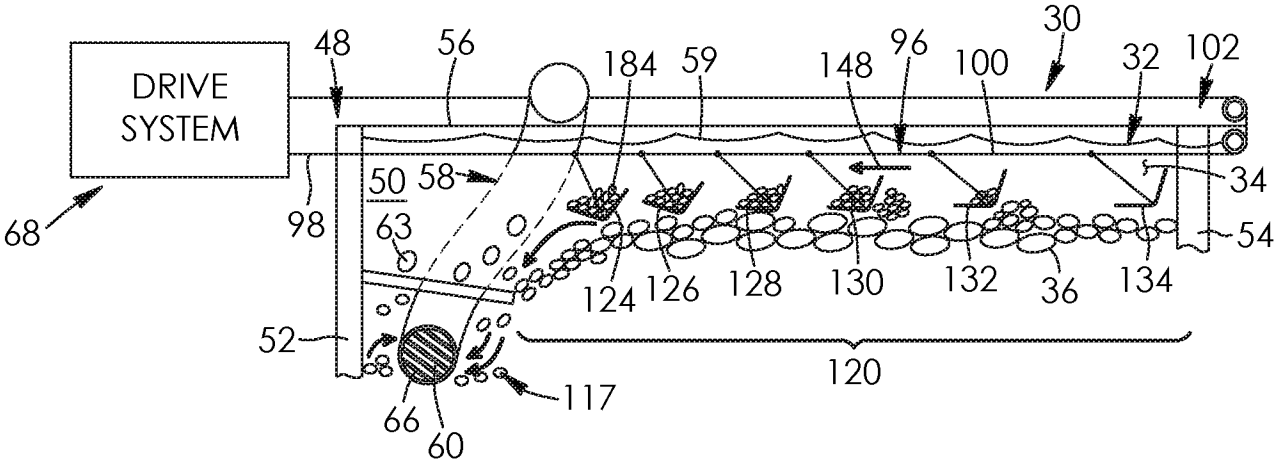
FIG. 1 is a schematic upstream elevation view of a dammed body of water together with a material transfer system according to a first aspect, the system including a conveyor having first and second longitudinal portions, each including a plurality of material displacement members and with only one of the longitudinal portions being shown, and the system further including a siphon to which material is directed by the conveyor.

Referring to the drawings and first to FIG. 1, there is shown a material transfer system for a body of water, in this example a fluvial material transfer system 30 for a dammed body of water, in this case a river 32. However, this is not strictly required the system as herein described may be used for other types of bodies of water in other examples.

Figure 2A:
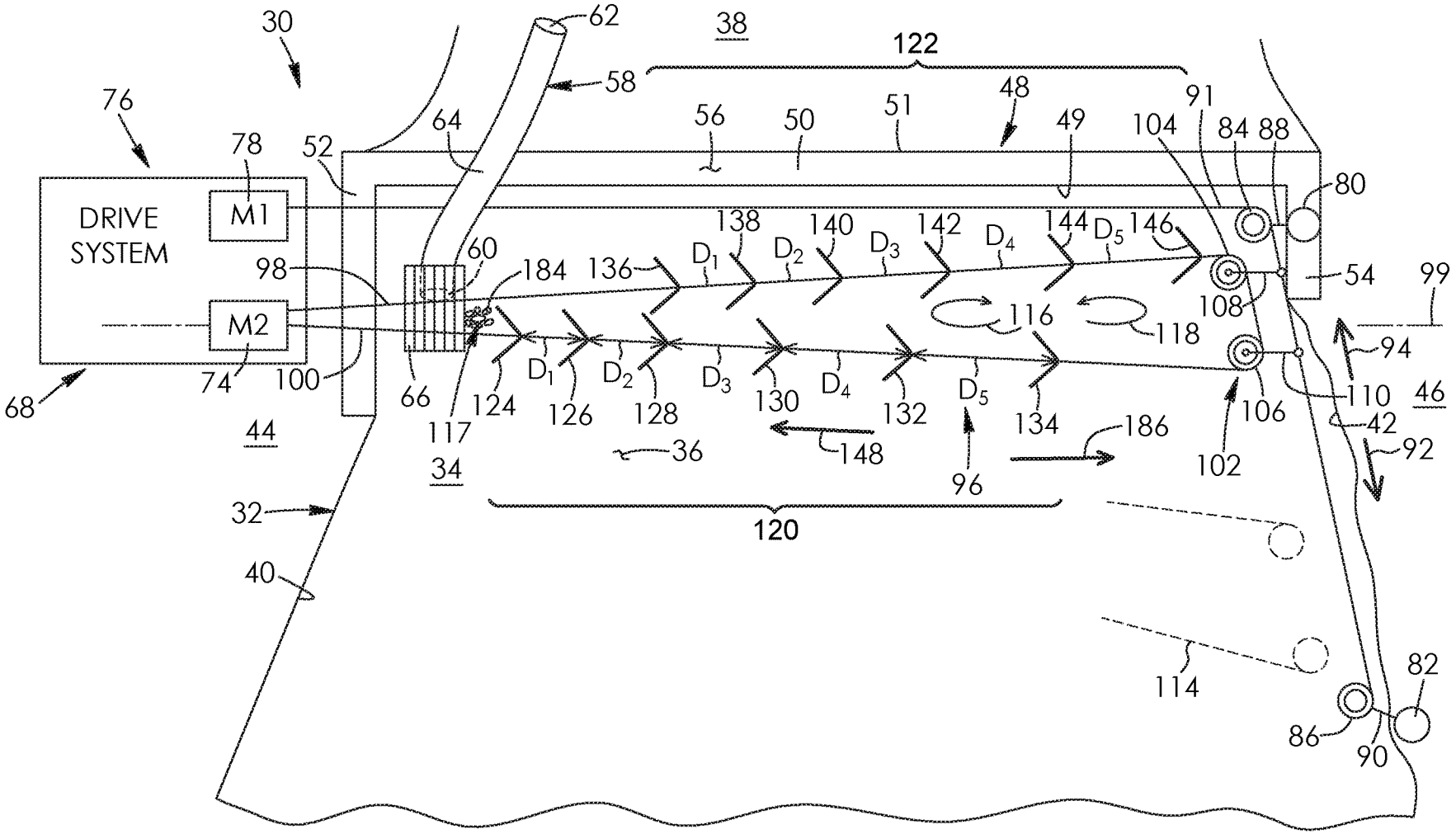
FIG. 2*a* is a schematic top plan view thereof.

As seen in FIG. 2*a*, the river 32 has a material-containing or upstream portion 34, an upstream bottom 36 located within the upstream portion, and a material-depositing or downstream portion 38. The river has a pair of spaced-apart sides 40 and 42 adjacent to which are located river banks 44 and 46.

Still referring to FIG. 2*a*, there is provided a dam, in this example a weir 48. The weir includes an end wall 50 and a pair of spaced-apart side walls 52 and 54 in this example between which the end wall couples and extends. The end wall extends between and divides the upstream portion 34 and downstream portion 38 of the river. Wall 50 of the weir 48 has an upstream-facing side 49 and a downstream-facing side 51. As seen in FIG. 1, the top 56 of the end wall 50 aligns above weir crest 59 of the upstream portion 34 of the river 32. Referring back to FIG. 2*a*, the side walls 52 and 54 of the weir 48 extend along river banks 44 and 46.

The system 30 includes a passageway, in this example a conduit, in this case a siphon 58. The siphon may be particularly suited to move material in the form of sediment having a sediment size of sand, which is common for glacier melt, with a maximum sediment size being at least three quarters of the diameter of the siphon one this example. The conduit diameter may be constrained by the in-stream flow requirement of the specific site. If one were discharging more water than the minimum in-stream flow requirement, this may result in lost production potential. The siphon may be used suited to sites with small sediment. Such sediment may be equal to or less than two inches in grain size in one example; however, this is not strictly required and the sediment may comprise different size ranges in other examples.

Figure 3:
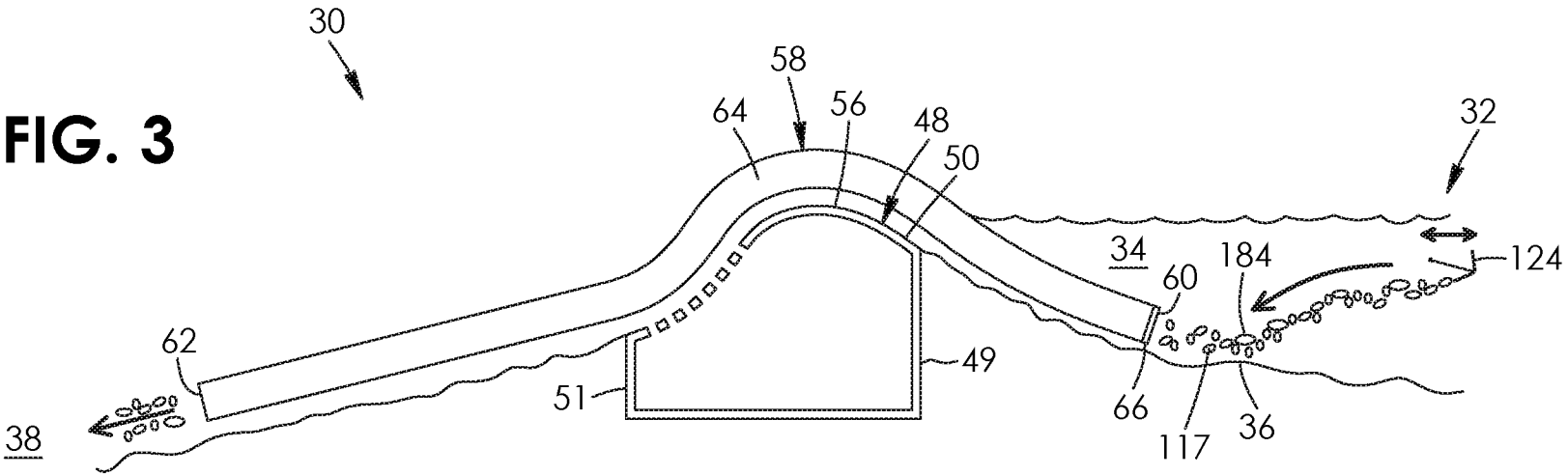
FIG. 3 is a side elevation view of the dammed body of water and the siphon of the system of FIG. 1, with the conveyor of the system shown in fragment.

The siphon is tubular in this example and has an inlet 60 in fluid communication with the upstream portion 34 of the river 32. The siphon has an outlet 62 downstream of the weir 48. As seen in FIG. 3, the outlet of the siphon 58 is positioned below the inlet 60 thereof. The siphon 58 has a middle portion 64 between and spaced above inlet 60 and outlet 62 thereof. The middle portion of the siphon 58 extends over the top 56 of the end wall 50 of the weir 48 in this example. In other examples, the siphon may extend under the weir 48 or through the weir or overflow structure, as shown in FIG. 33 for system 30.16 in which like parts have like numbers with the addition of decimal extension ".16".

Figure 33:
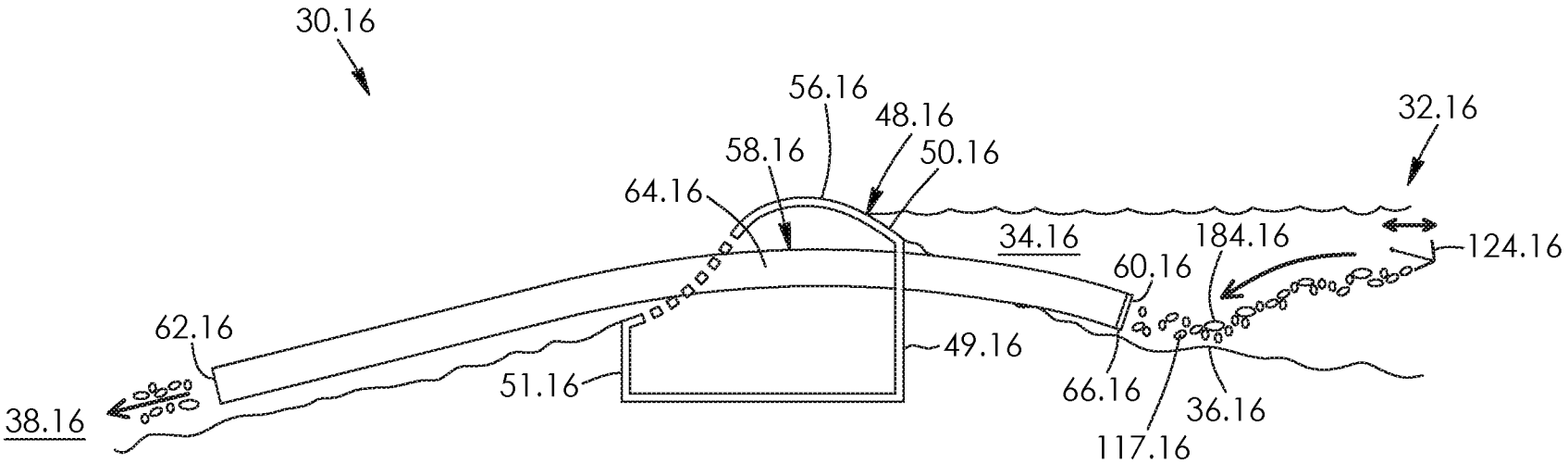
FIG. 33 is a side elevation view of a dammed body of water and a siphon of a material transfer system similar to FIG. 3 according to a seventeenth embodiment, the siphon being shown extending through one of a weir or overflow structure.

In FIG. 33 the siphon 58.16 may extend through the intake structure. Alternatively the siphon may extend through the overflow structure, located on either side of the intake screen, rather than the actual intake screen, which is the curved surface of the weir shown in FIG. 33. The siphon may be routed closer to the motor base, crossing through the weir near the edge of the weir structure, in one example.

Referring back to FIG. 2*a*, the system 30 includes a screen 66 which extends across the inlet 60 of the siphon. The screen is shaped to inhibit clogging debris, such as large rocks 63, logs and the like, from entering the siphon 58.

Figure 4:
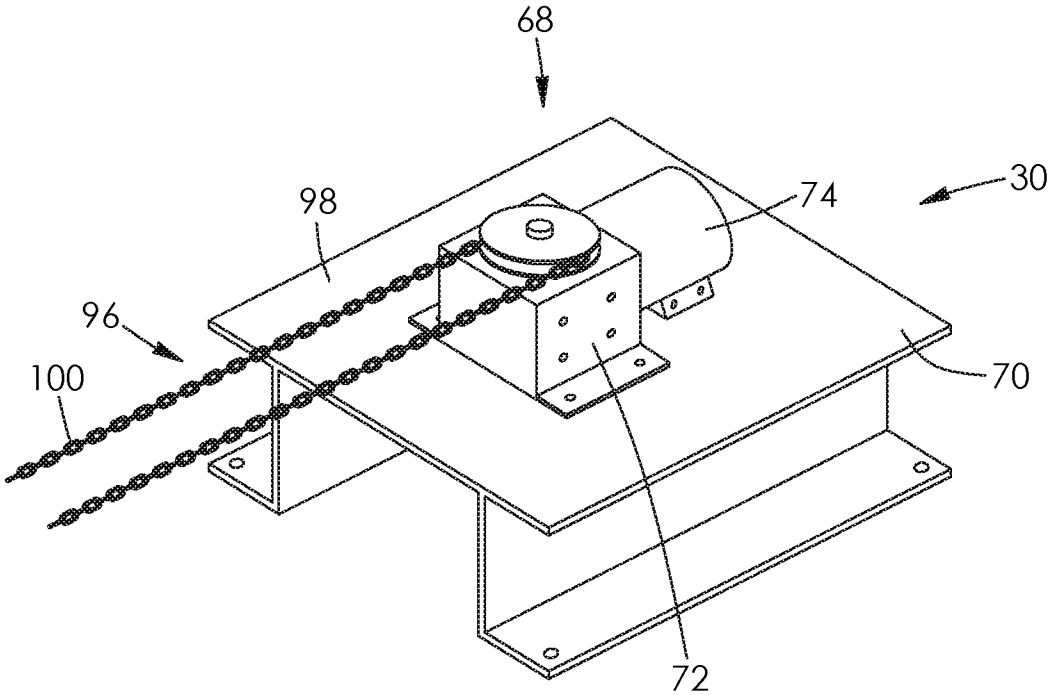
FIG. 4 is a perspective view of a conveyor drive assembly of the system of FIG. 1.

The system 30 includes a conveyor drive assembly, in this example a reciprocating drive assembly 68 located on bank 44 adjacent to side 40 of the river 32. As seen in FIG. 4, the assembly includes a mount 70, a gear box 72 connected to the mount, and a motor 74 connected to the mount and operatively coupled to the gear box. The assembly 68 is configured to provide reciprocating motion to equipment connected thereto. This is one example only of a mounting system and those skilled in the art will appreciate that other mounting and mechanical means to provide motion to the two ends of flexible line are possible, such as a hydraulic cylinder to move the flexible line, for example. Reciprocating drive assemblies are known per se and assembly 68 will thus not be described in further detail.

Referring to FIG. 2*a*, the system 30 includes a conveyor position adjustment assembly 76. The assembly includes a motor 78 located on bank 44 in this embodiment adjacent to motor 74 of the reciprocating drive assembly in this example. The conveyor position adjustment assembly 76 in this case includes a pair of fixed support structures, in this example posts 80 and 82 coupled to and, in this example, pile driven into bank 46 adjacent to side 42 of the river 32. The conveyor position adjustment assembly includes a pair of spaced-apart, moveable anchor points, in this example pulleys 84 and 86.

The pulleys are movable by mechanical means, such as a wheel system, cable system or rails, and in this example are coupled to respective ones of the posts in this example via length-adjustable members, in this example tethers 88 and 90. Pulley 86 is self-tensioning in this example. The conveyor position adjustment assembly 76 includes a line, in this example a cable 91 located adjacent to the upstream portion 34 of the river 32. The cable couples to motor 78, extends about the spaced-apart pulleys 84 and 86 and is selectively moveable in upstream and downstream directions 92 and 94 via motor 78.

Referring to FIG. 2*a*, the system 30 includes a reciprocating conveyor 96. The conveyor extends about and couples to motor 74. As seen in FIG. 1, the conveyor is configured to convey material, in this example fluvial material 184 towards the inlet 60 of the siphon 58, with the fluvial material passing through the siphon thereafter. The material may cover a variety of objects, including but not limited to clay, silt, sand, gravel, cobbles, wood, contaminated materials and the like.

As seen in FIG. 2*a*, the conveyor 96 has a first end portion 98 which aligns with the inlet 60 of the siphon 58. The conveyor includes a loop-shaped carrying medium, in this example a flexible line 100 to which the reciprocating drive assembly 68 couples. The flexible line may be referred to as a drive line and may comprise a chain, cable or rope, for example. The conveyor 96 is thus operatively coupled to the reciprocating drive assembly. Motor 74 couples to the flexible line 100 and causes the conveyor to move in a reciprocating manner in this example.

The flexible line of the conveyor 96 has a second end portion 102 spaced-apart from the first end portion 98 thereof. The conveyor extends along a longitudinal axis 99 which extends through the first end portion thereof and the second end portion thereof. The conveyor 96 includes a pair of pulleys, in this example floating pulleys 104 and 106. The flexible line 100 extends about the floating pulleys adjacent to the second end portion of the conveyor in this example. The pulleys 104 and 106 couple to cable 91 of conveyor position adjustment assembly 76 via length-adjustable members, in this example tethers 108 and 110, respectively.

The second end portion 102 of the conveyor 96 is moveable incrementally from a first position shown in solid lines in FIG. 2*a* adjacent to end wall 50 of weir 48 to a second position 114 spaced-apart upstream from the weir and shown in dotted lines. The conveyor position adjustment assembly 76 thus selectively moves the second end portion of the conveyor relative to the first end portion 98 of the conveyor as needed to gradually remove fluvial material built up along the upstream bottom 36 of the river 32 seen in FIG. 1. Thus and referring back to FIG. 2*a*, motor 78 actuates cable 91 to move forwards and rearwards to selectively move the second end portion 102 of the conveyor in this embodiment. The floating pulleys 104 and 106 are therefore selectively moveable relative to the first end portion 98 of the conveyor 96. The pulleys are also thus selectively moveable and rotatable about motor 74. The conveyor position adjustment assembly 76 selectively rotates the conveyor 96 about an end thereof.

Still referring to FIG. 2*a*, the conveyor moves in a first rotational direction seen by arrow of numeral 116 and a second rotational direction, seen by arrow of numeral 118, opposite the first rotational direction.

The conveyor 96 includes a first longitudinal portion 120 and a second longitudinal portion 122. Only longitudinal portion 120 is shown in FIG. 1 for clarity. The portions are spaced-apart from each other and extend in parallel with each other in this example. The conveyor includes at least one, and in this example a plurality of longitudinally spaced-apart material displacement members coupled to the flexible line 100 per longitudinal portion of the conveyor, with in this example: material displacement members 124, 126, 128, 130, 132 and 134 for longitudinal portion 120 of the conveyor 96 and material displacement members 136, 138, 140, 142, 144 and 146 for longitudinal portion 122 of the conveyor. In other embodiments only one of the longitudinal portions of the conveyor may include said one or more material displacement members. Some of the material displacement members described herein may be referred to as plows or scoop members. Each material displacement member is shaped to receive and convey fluvial material in one direction, in this example a collection direction shown by arrow of number 148 which extends from side 42 towards side 40 of the river 32.

Figure 5:
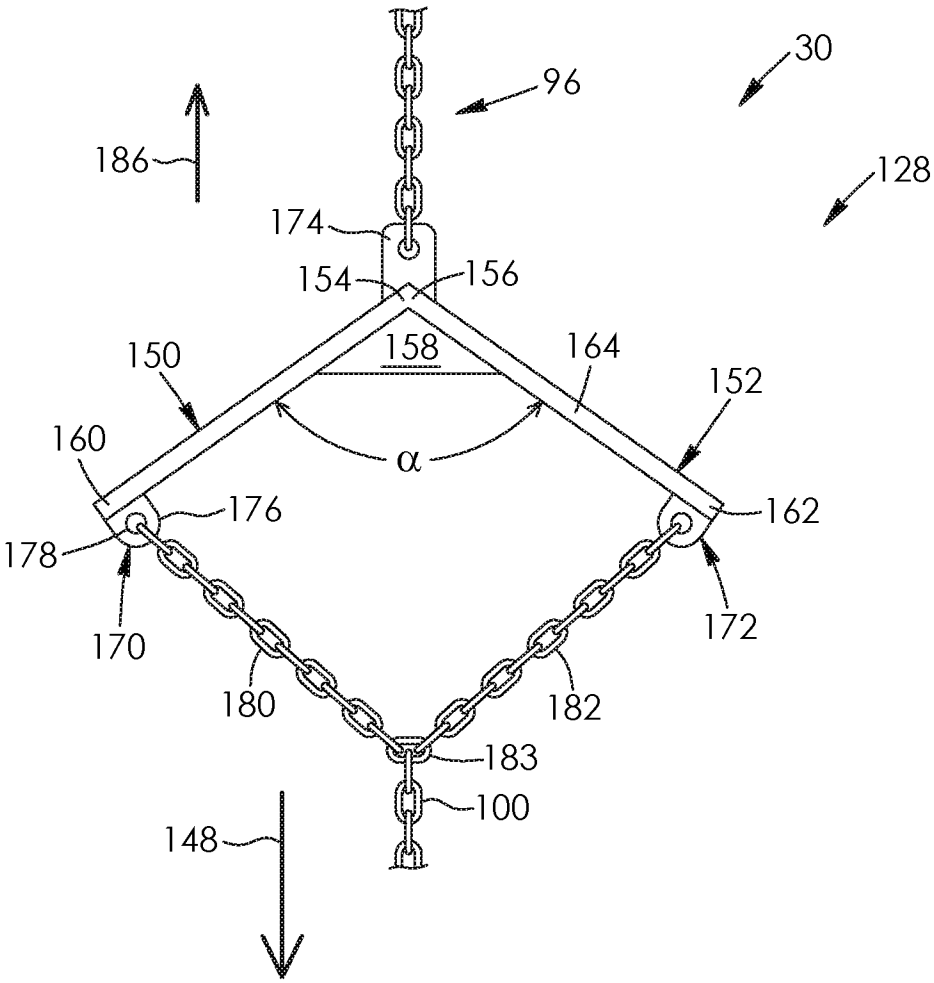
FIG. 5 is a top plan view of one of the plurality of material displacement members of the conveyor of FIG. 1.

Each material displacement member, as shown by material displacement member 128 in FIG. 5, is V-shaped in top and bottom plan view in this embodiment. Alternatively, the material displacement members may be V-shaped in side profile as shown in FIG. 1. Each material displacement member comprises a pair of planar members, in this example metal plates 150 and 152. The plates have inner ends 154 and 156 that couple together in this example. Metal plate 150 extends outwards at an angle α relative to metal plate 152, with angle α being equal to 120 degrees in this example. However, this is not strictly required and angle α may be different in other embodiments.

Figure 6:
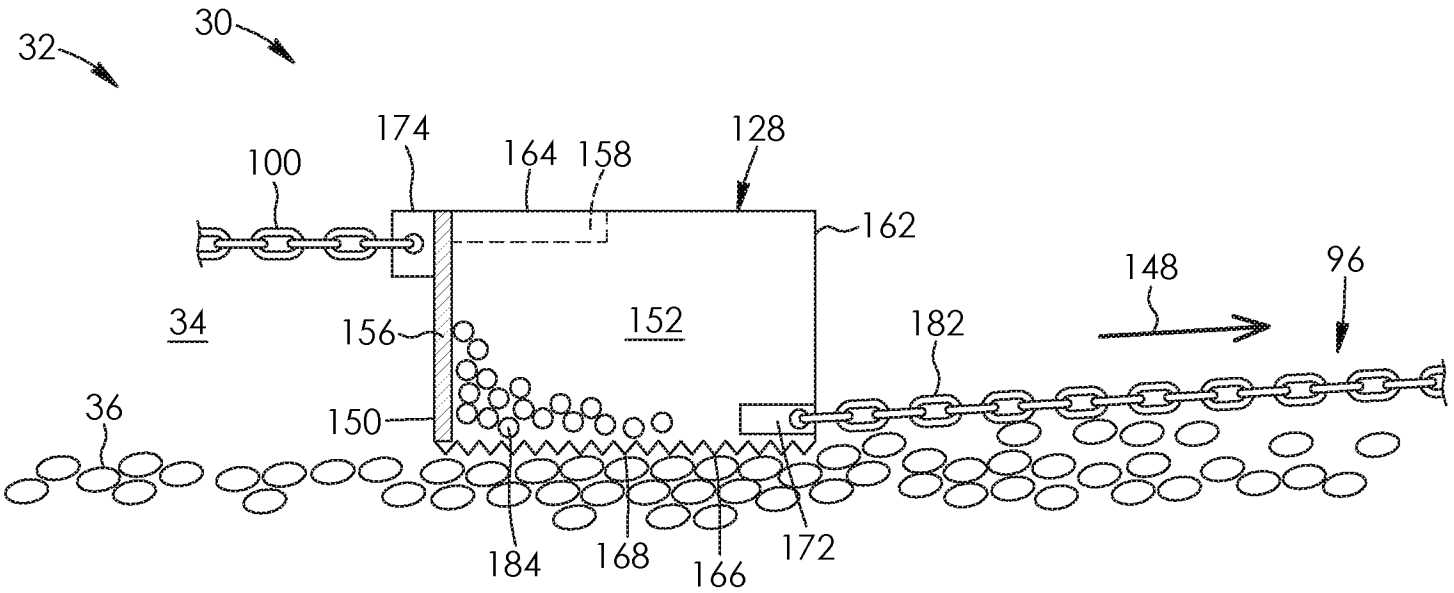
FIG. 6 is an upstream elevation view of the material displacement member of FIG. 5 shown moving in a first direction of movement in which material is collected therein, with one of the metal plates of the material displacement member shown partially removed and in fragment.

Each material displacement member 128 includes a brace 158 which is triangular in top and bottom plan view in this example. The brace extends between the plates 150 and 152 and extends from the inner ends 154 and 156 of the plates towards outer ends 160 and 162 of the plates. As seen in FIG. 6, each material displacement member 128 has a top 164 and a bottom 166. Brace 158 extends along the top of the material displacement member in this example. Each material displacement member 128 includes a plurality of serrated edges 168 extending along the bottom 166 thereof in this embodiment.

Referring back to FIG. 5, each material displacement member 128 in this embodiment includes a pair of lower couplers 170 and 172 connected to the outer ends 160 and 162 of the plates 150 and 152 and an upper coupler 174 connected to the inner ends 154 and 156 of the plates. Each coupler comprises a tab 176 with an aperture 178 extending therethrough. As seen in FIG. 6, upper coupler 174 aligns with the top 164 of the material displacement member 128 and flexible line 100 couples thereto. The lower couplers align near the bottom 166 of the material displacement member, as seen by coupler 172 in FIG. 6. Referring back to FIG. 5, lower couplers 170 and 172 connect to flexible line 100 in this example via elongate flexible connecting members, in this example connector flexible lines 180 and 182 and connecting ring 183.

As seen in FIG. 6, in this embodiment each material displacement member 128 is pulled adjacent to the bottom 166 thereof when moving in the collection direction 148 and conveying fluvial material 184 towards the inlet 60 of the siphon 58, as seen in FIG. 1. In this manner, each material displacement member is configured to extend along and adjacent to the upstream bottom 36 of the river 32.

Figure 7:
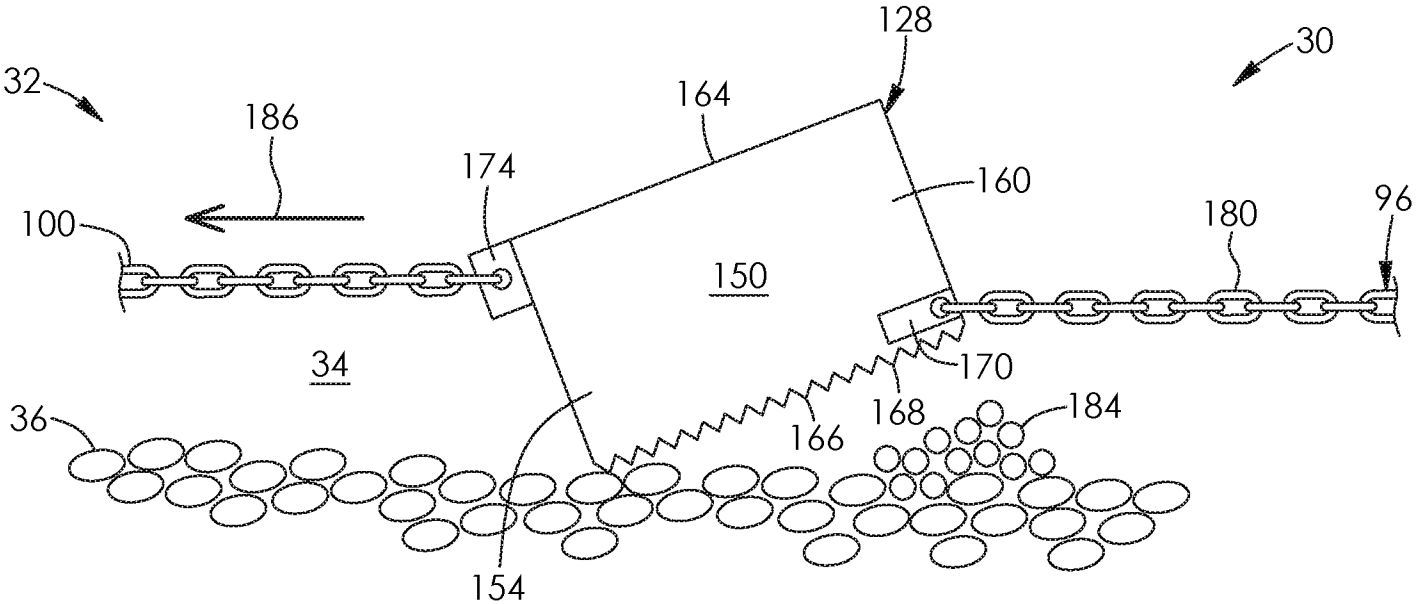
FIG. 7 is an upstream elevation view of the material displacement member of FIG. 6 shown moving in a second direction of movement in which collection of material therein is inhibited.

As seen in FIG. 7, each material displacement member 128 in this embodiment is pulled adjacent to the top 164 thereof when inhibiting collection of the fluvial material, as shown by return direction of numeral 186. The material displacement members are thus shaped to promote collection of the fluvial material 184 in a first direction of movement, shown by arrow 148 in FIG. 6, and shaped to inhibit collection of the fluvial material in a second direction of movement, shown by arrow 186 in FIG. 7, which is opposite the first direction of movement.

Referring to FIG. 2*a*, the material displacement members 124, 126, 128, 130, 132 and 134 of the first longitudinal portion 120 of the conveyor 96 are configured to promote collection of the fluvial material 184 therein when the conveyor moves in the first rotational direction 116 towards a collection area 117 and are shaped to inhibit collection of the fluvial material therein when the conveyor moves in the second rotational direction 118. The material displacement members 136, 138, 140, 142, 144 and 146 of the second longitudinal portion 122 of the conveyor are shaped to inhibit collection of the fluvial material when the conveyor moves in the first rotational direction 116 and are shaped to promote collection of the fluvial material therein when the conveyor moves in the second rotational direction 118 and incrementally move said material towards the collection area 117.

Still referring to FIG. 2*a*, in this example the material displacement members located further away from the siphon 58 and collection area 117, in this case, material displacement members 130, 132, 134, 142, 144 and 146, are smaller than the material displacement members 124, 126, 128, 136, 138 and 140 located closer to the siphon. The material displacement members may have a volume range of 0.01 cubic meters to 0.1 cubic meters, for example. However, this is not strictly required and the preferred volume would be dependent on material size (coarse or fine). The system 30 may be shaped to be relatively portable; however, here too this is not strictly required and the system may not be portable in other embodiments.

Also in this embodiment, the material displacement members located closer to the siphon 58 and collection area 117, in this example material displacement members 124, 126, 128, 136, 138 and 140, are closer to each other than the material displacement members 130, 132, 134, 142, 144 and 146 located further away from the siphon in this example. However, this is not strictly required. The size of the material displacement members may comprise incrementally varying sizes, as seen in FIG. 32 for system 30.15 in which like parts have like numbers with the addition of decimal extension ".15", or the spacing therebetween may be altered, or both the size and spacing of the material displacements may be altered, for tailoring to specific environments as needed.

Figure 32:
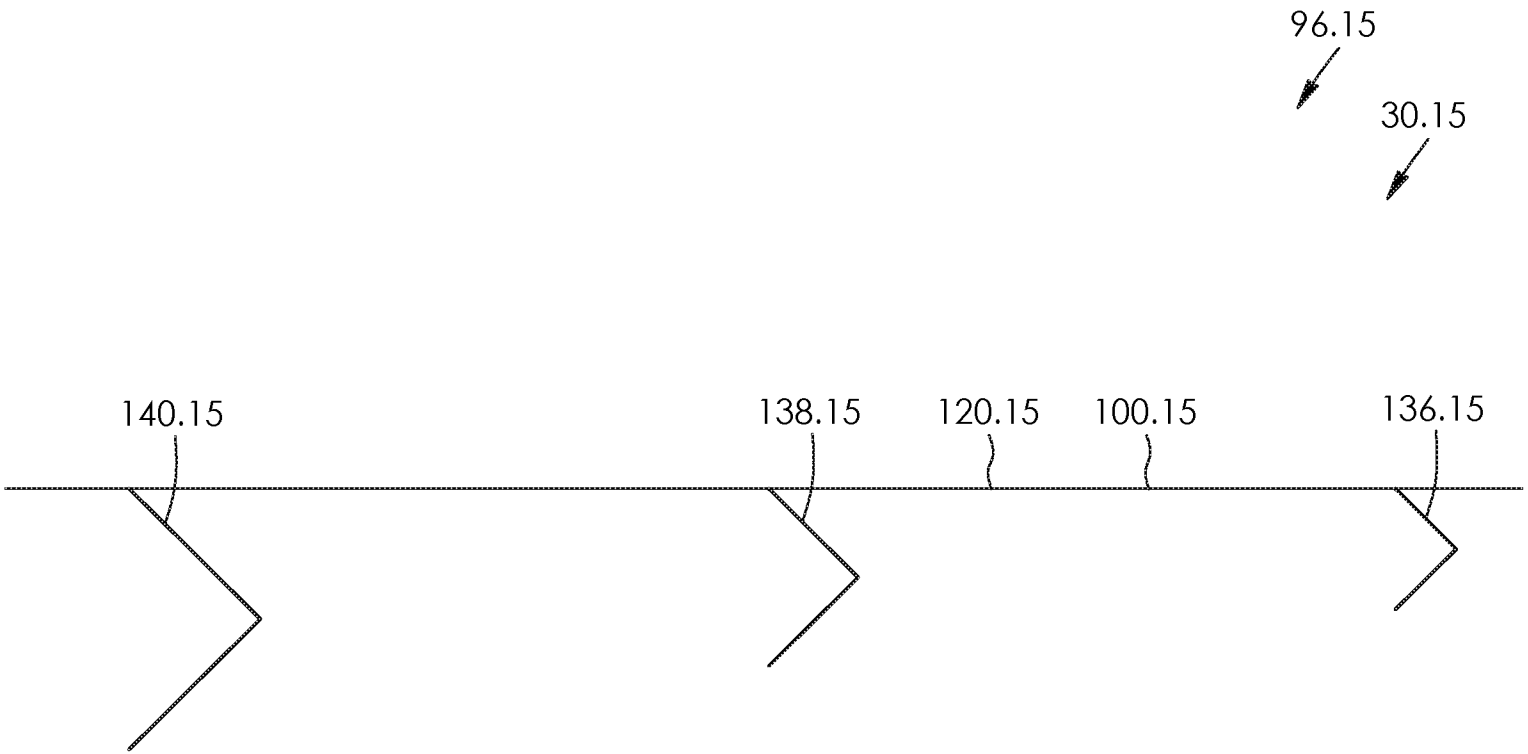
FIG. 32 is a schematic view of a series of material displacement members of incrementally different sizes of a material transfer system according to a sixteenth embodiment.

In FIG. 32, the increasing material displacement member or bucket size is shown with cross sectional areas of one unit, two units, and three units. The furthest material displacement member or bucket excavates one unit volume, then the next one transfer that unit volume and excavates another unit volume on top of the transferred material, thus the need for 2 unit volume capacity, and the rest of the series goes on in a similar fashion. This is not strictly required and other size variations are possible in other examples.

In the example shown in FIG. 2*a*: distance of separation $D_1$ between material displacement members 124 and 126 and between material displacement members 136 and 138, is less than the distance of separation $D_2$ between material displacement members 126 and 128 and between material displacement members 138 and 140; distance of separation $D_2$ between material displacement members 126 and 128 and between material displacement members 138 and 140, is less than the distance of separation $D_3$ between material displacement members 128 and 130 and between material displacement members 140 and 142; distance of separation $D_3$ between material displacement members 128 and 130 and between material displacement members 140 and 142, is less than the distance of separation $D_4$ between material displacement members 130 and 132 and between material displacement members 142 and 144; and distance of separation $D_4$ between material displacement members 130 and 132 and between material displacement members 142 and 144, is less than the distance of separation $D_5$ between material displacement members 132 and 134 and between material displacement members 144 and 146.

Still referring to FIG. 2*a*, longitudinal portion 120 of the conveyor 96 extends between material displacement member 124 and material displacement member 134. Longitudinal portion 120 of the conveyor is configured to move from a first position shown in FIG. 2*a* in which material displacement member 124 is near inlet 60 of siphon 58 and in this example is adjacent to the inlet of the siphon, to a second position in which material displacement member 134 is near pulley 106 and in this example is adjacent to the pulley. Longitudinal portion 122 of the conveyor 96 extends between material displacement member 136 and material displacement member 146. Longitudinal portion 122 of the conveyor is configured to move from a first position shown in FIG. 2*a* in which material displacement member 146 is near pulley 104 and in this example is adjacent to the pulley, to a second position in which material displacement member 136 is near inlet 60 of siphon 58 and in this example is adjacent to the inlet of the siphon.

In this manner and as seen in FIGS. 1 and 3, the conveyor 96 is thus configured via reciprocating drive assembly 68 to move between the above referred-to positions in a reciprocating manner. Thus referring to FIG. 1: material displacement members 134 and 146, when moving in collection direction 148, incrementally promote collection of and movement of fluvial material 184 towards material displacement members 132 and 144. Members 134 and 146 are shaped to inhibit collection of material when moving in return direction 186. Material displacement members 132 and 144 when moving in collection direction 148 incrementally promote collection of and movement of fluvial material adjacent thereto towards material displacement members 130 and 142 and are shaped to inhibit collection of material when moving in return direction 186. Material displacement members 130 and 142 when moving in collection direction 148 incrementally promote collection of and movement of fluvial material adjacent thereto towards material displacement members 128 and 140 and are shaped to inhibit collection of material when moving in return direction 186. Material displacement members 128 and 140 when moving in collection direction 148 incrementally promote collection of and movement of fluvial material adjacent thereto towards material displacement members 126 and 138 and are shaped to inhibit collection of material when moving in return direction 186. Material displacement members 126 and 138 when moving in collection direction 148 incrementally promote collection of and movement of fluvial material adjacent thereto towards material displacement members 124 and 136 and are shaped to inhibit collection of material when moving in return direction 186. Material displacement members 124 and 136 when moving in collection direction 148 promote collection of and movement of fluvial material adjacent thereto towards inlet 60 of siphon 58 and collection area 117, and are shaped to inhibit collection of material when moving in return direction 186.

Figure 2B:
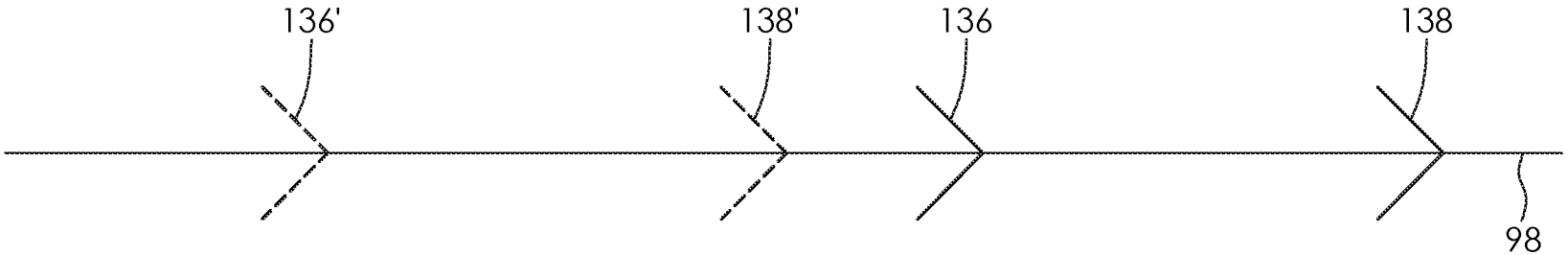
FIG. 2*b* is an enlarged schematic view of one of the longitudinal portions of the conveyor of FIG. 1, showing a pair of the material displacement members thereof in first positions in solid lines, and shown in second positions shown in stippled lines.

Movement ranges of adjacent material displacement members overlap as seen in FIG. 2*b*. FIG. 2*b* shows a pair of adjacent material displacement members 136 and 138 and their respective positions at the start and end of their stroke. Material displacement members 136 and 138 are shown in solid lines in first positions and shown in stippled lines in second positions 136' and 138'. As seen in FIG. 2*b*, second position 138' of the displacement member 138 thus extends past first position of displacement member 136.

Referring to FIG. 3, the siphon is configured to promote passage of material 184 so collected adjacent to the inlet 60 thereof, towards the outlet 62 thereof located in the downstream portion 38 of the river 32. In this manner, fluvial material build up at the upstream portion 34 of the river 32 arising because of weir 48 may be inhibited by the system 30 as herein described.

The system 30 as herein described may facilitate gradual removal of fluvial material. For example, in one embodiment, the system may remove material at a rate of 1 to 2 cubic meters per hour. However, this is not strictly required and on bigger systems 100 to 200 cubic meters per hour may be removed, for example.

Figure 8:
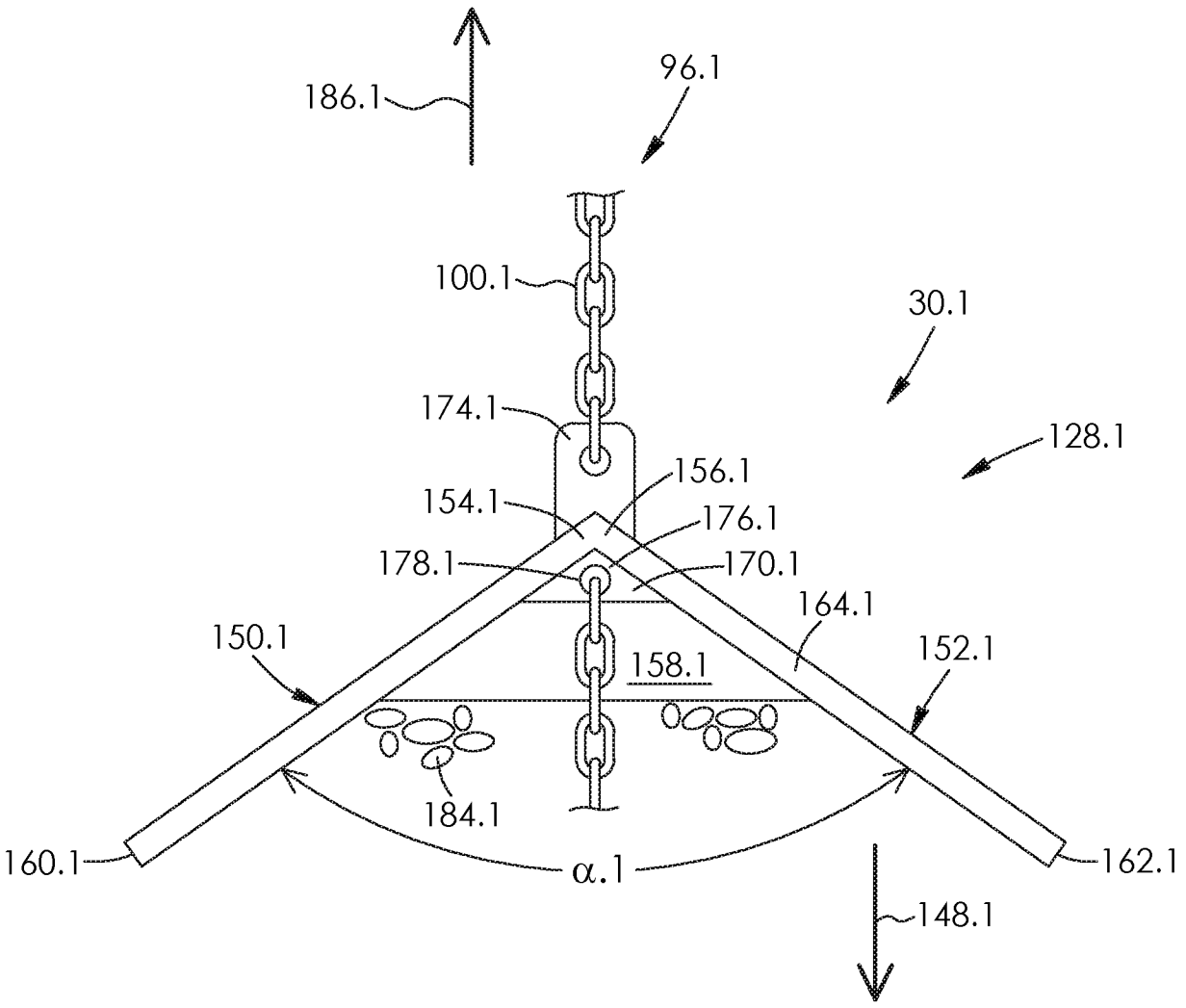
FIG. 8 is a top plan view of a material displacement member of a conveyor of a material transfer system according to a second aspect.

FIG. 8 shows a material displacement member 128.1 for a material transfer system 30.1 according to a second aspect. Like parts have like numbers and functions as the material displacement members 128 and material transfer system 30 shown in FIGS. 1 to 7 with the addition of decimal extension ".1". System 30.1 is substantially the same as system 30 shown in FIGS. 1 to 7 with the following exceptions. Each material displacement member 128.1 comprises a single lower coupler 170.1 located adjacent to the inner ends 154.1 and 156.1 of the plates 150.1 and 152.1 and adjacent to brace 158.1. Each brace 158.1 is elongate and spaced-apart from the inner ends of the plates in this example.

Figure 9:
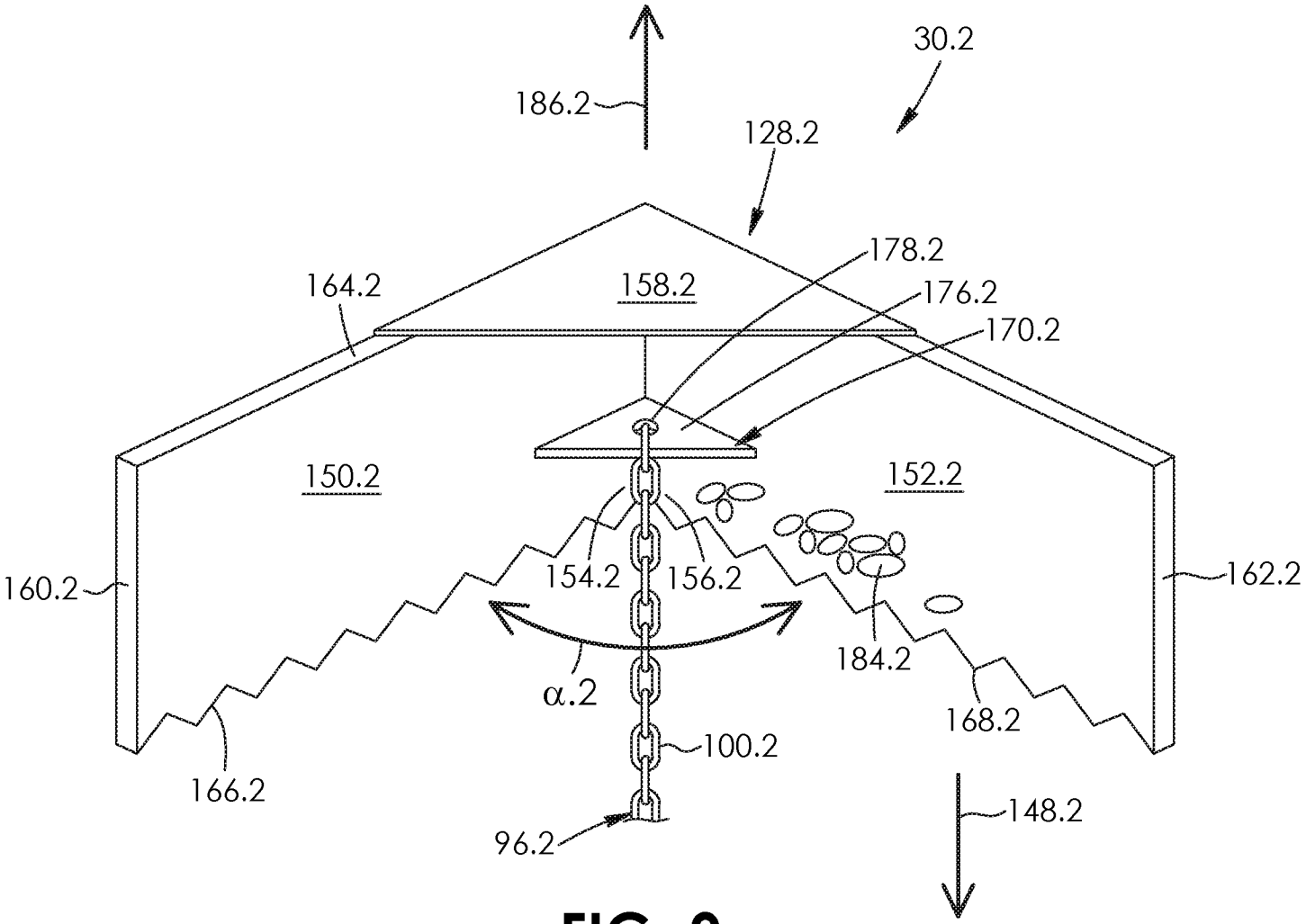
FIG. 9 is a top, side perspective view of a material displacement member of a conveyor of a material transfer system according to a third aspect.

FIG. 9 shows a material displacement member 128.2 of a material transfer system 30.2 according to a third aspect. Like parts have like numbers and functions as the material displacement members 128.1 and material transfer system 30.1 shown in FIG. 8 with decimal extension ".2" replacing decimal extension ".1". System 30.2 is substantially the same as system 30.1 shown in FIG. 8 with the following exception. The brace 170.2 of each material displacement member 128.2 is triangular in top and bottom plan view in this example.

Figure 10:
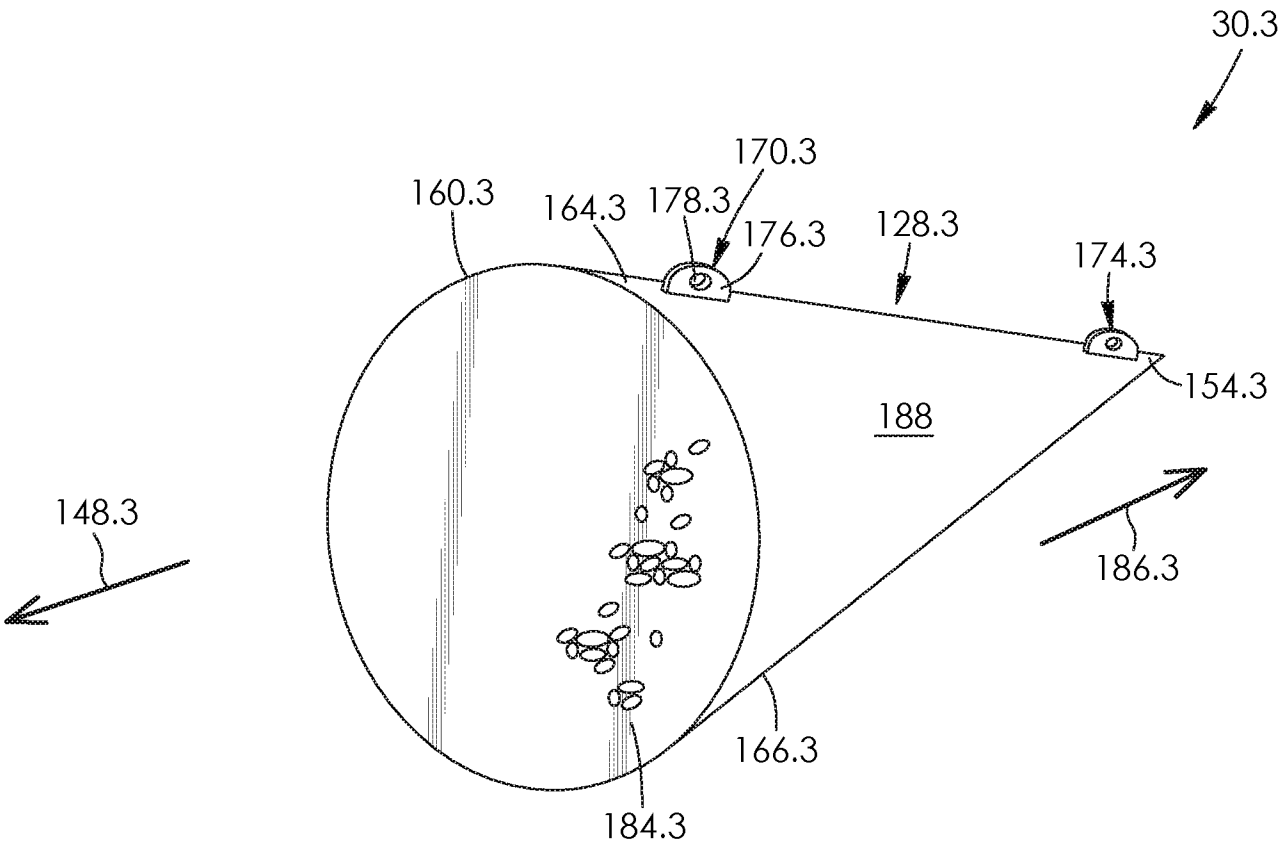
FIG. 10 is a perspective view of a material displacement member of a conveyor of a material transfer system according to a fourth aspect.

FIG. 10 shows a material displacement member 128.3 of a material transfer system 30.3 according to a fourth aspect. Like parts have like numbers and functions as the material displacement members 128 and material transfer system 30 shown in FIGS. 1 to 7 with the addition of decimal extension ".3". System 30.3 is substantially the same as system 30 shown in FIGS. 1 to 7 with the following exceptions.

Each material displacement member 128.3 has a cone shape in exterior shape in this embodiment. Each material displacement member includes an annular outer wall 188 which tapers in a direction extending from outer closed end 160.3 towards inner closed end 154.3 thereof. Couplers 170.3 and 174.3 align along the top 164.3 of the member 128.3 and couple to wall 188 adjacent to ends 160.3 and 154.3, respectively.

Each material displacement member 128.3 has a planar end 160.3 against which material 184.3 is received and/or abuts when the material displacement member is moving in collection direction 148.3. The material displacement member 128.3 is thus shaped to help push a desired volume of material. The tapered closed end 154.3 of each material displacement member 128.3 inhibits the collection of material when the material displacement member is moved in the return direction 186.3.

Figure 11:
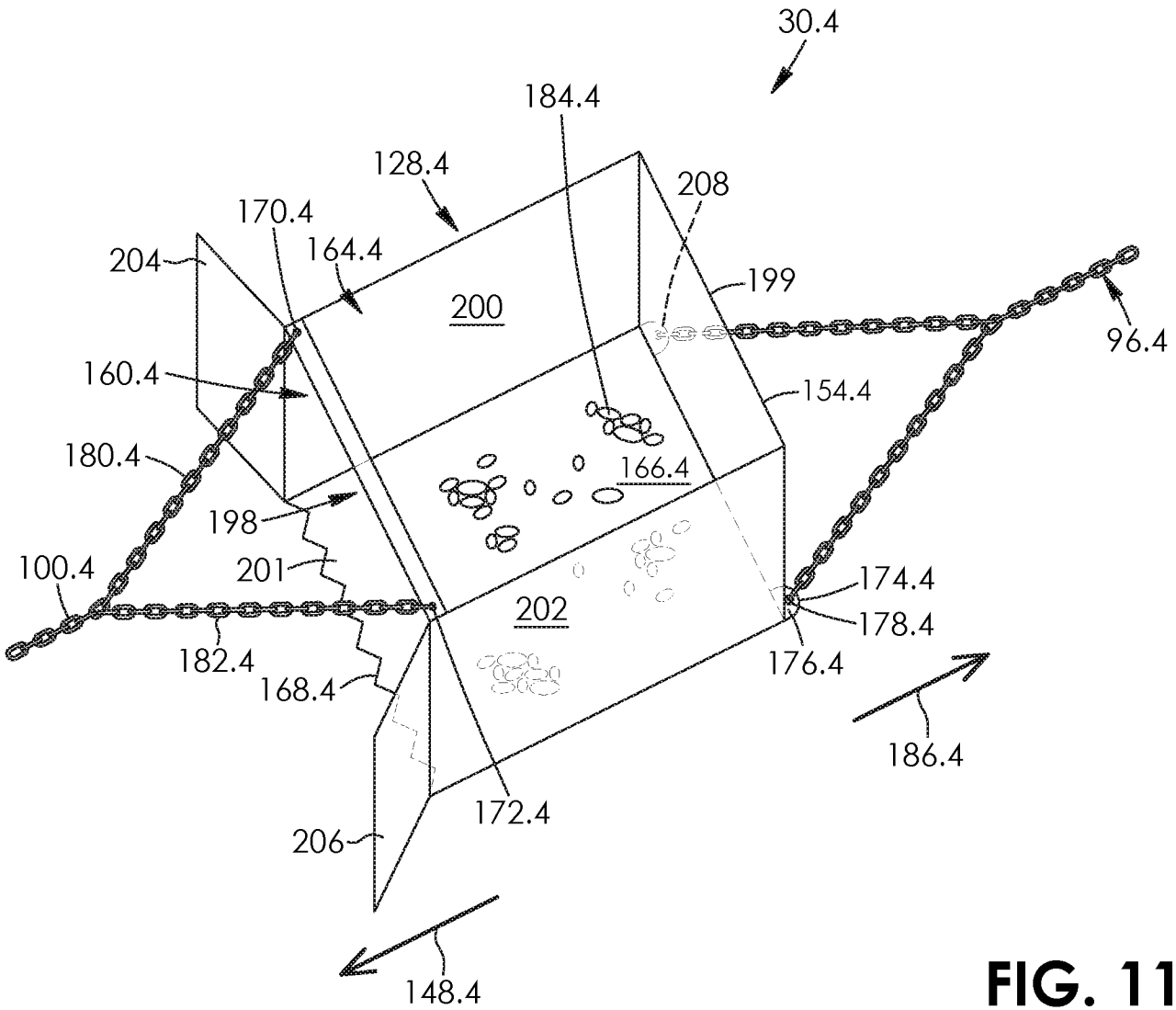
FIG. 11 is a perspective view of a material displacement member of a conveyor of a material transfer system according to a fifth aspect.

FIG. 11 shows a material displacement member 128.4 of a material transfer system 30.4 according to a fifth aspect. Like parts have like numbers and functions as the material displacement members 128 and material transfer system 30 shown in FIGS. 1 to 7 with the addition of decimal extension ".4". System 30.4 is substantially the same as system 30 shown in FIGS. 1 to 7 with the following exceptions.

Each material displacement member 128.4 has a box shape and is generally rectangular in this embodiment. Each material displacement member has a hollow interior 198, a first open end 160.4, and a second closed end 154.4 spaced-apart from the first open end thereof. End member 199 extends along end 154.4 and is rectangular in this example. An opening 201 aligns with end 160.4 in this example and is in fluid communication with interior 198. Each material displacement member 128.4 has a pair of sides 200 and 202 which are rectangular in this example and which extend between ends 160.4 and 154.4 thereof. Each material displacement member has an open top 164.4 and a closed bottom 166.4, with the top and bottom being rectangular in shape in this example.

Each material displacement member 128.4 includes a pair of flanges 204 and 206 adjacent to end 160.4 thereof. The flanges are rectangular in this example and are shaped to direct material 184.4 through opening 201 and towards interior 198 of the material displacement member 128.4 when the material displacement member is moving in the collection direction 148.4. End member 199 is shaped to inhibit collection of the material when the material displacement member is moving in the return direction 186.4.

Couplers 170.4 and 172.4 are positioned adjacent to end 160.4 and top 164.4 of the material displacement member 128.4 in this example. The conveyor 96.4 pulls couplers 170.4 and 172.4 when the material displacement member is moving in the collection direction 148.4. Each material displacement member 128.4 includes a pair of couplers 174.4 and 208 adjacent to end 154.4 and bottom 166.4 of the material displacement member. The conveyor 96.4 pulls couplers 174.4 and 208 when the material displacement member is moving in the return direction 186.4.

Figure 12:
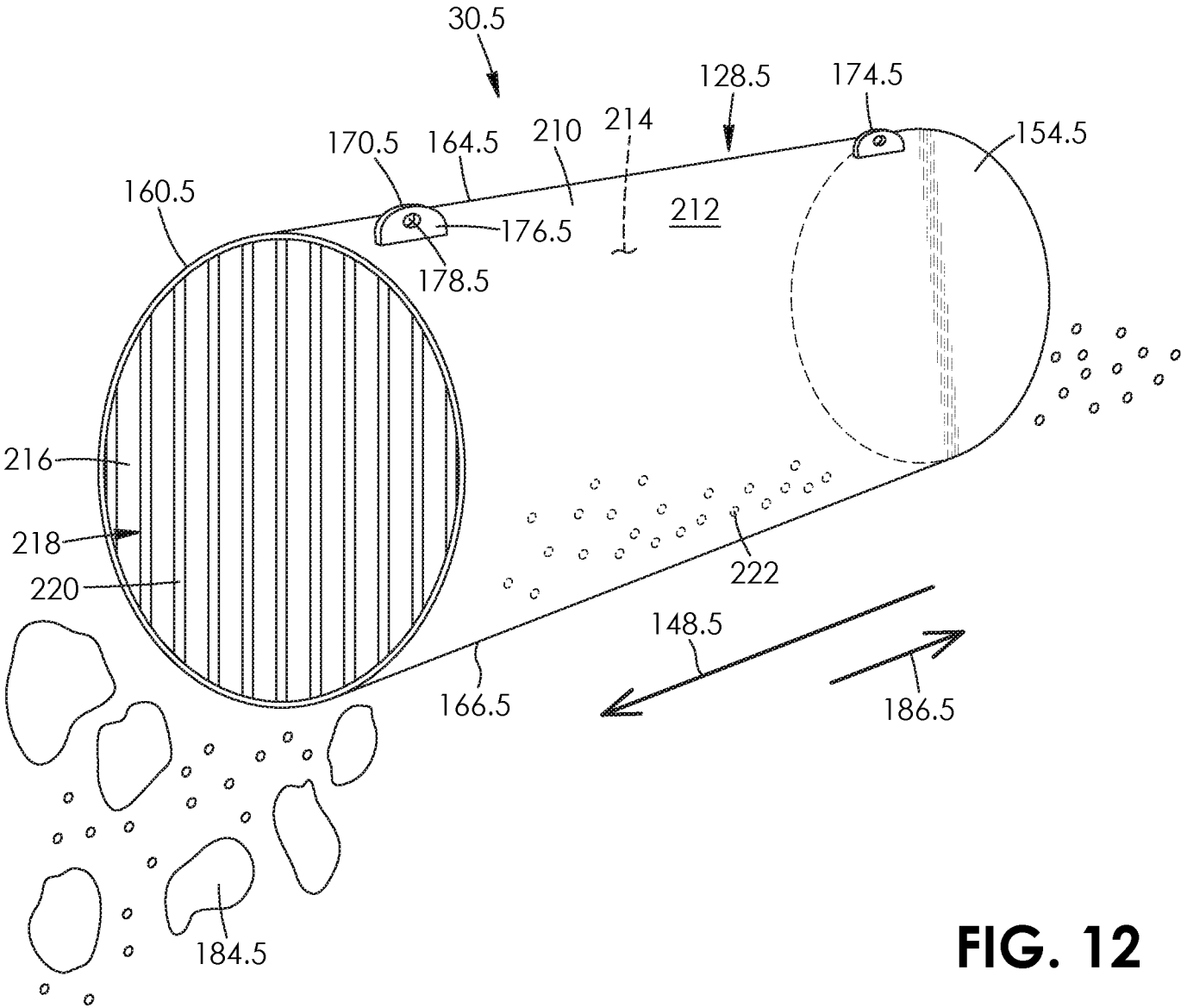
FIG. 12 is a perspective view of a material displacement member of a conveyor of a material transfer system according to a sixth aspect.

FIG. 12 shows a material displacement member 128.5 of a material transfer system 30.5 according to a sixth aspect. Like parts have like numbers and functions as the material displacement members 128 and material transfer system 30 shown in FIGS. 1 to 7 with the addition of decimal extension ".5". System 30.5 is substantially the same as system 30 shown in FIGS. 1 to 7 with the following exceptions.

Each material displacement member 128.5 includes an enclosure, in this example a conduit, in this case a segment of pipe 210 with a pair of spaced-apart open ends 160.5 and 154.5. The conduit may be referred to as a sleeve or as being tubular in shape with a circular cross-section in this example. Each displacement member 128.5 includes an annular outer wall 212 and has an interior 214 around which the outer wall extends. Each material displacement member has an opening 216 that is circular in this example and which is adjacent to end 160.5 thereof. Each displacement member 128.5 includes a screen 218 comprising a plurality of spaced-apart bars 220. The bars in this example extend across opening 216 in a vertical direction extending from the bottom 166.5 towards the top 164.5 of the segment of pipe 210 in this example. The screen 218 is configured to enable smaller material 222 to passing therethrough and to inhibit larger material 184.5 from passing therethrough. End 160.5 of material displacement member 128.5 thus inhibits material of a predetermined size from passing therethrough.

Couplers 170.5 and 174.5 align along the top 164.5 of material displacement member 128.5 and couple to wall 212 adjacent to ends 160.5 and 154.5, respectively.

Figure 13A:
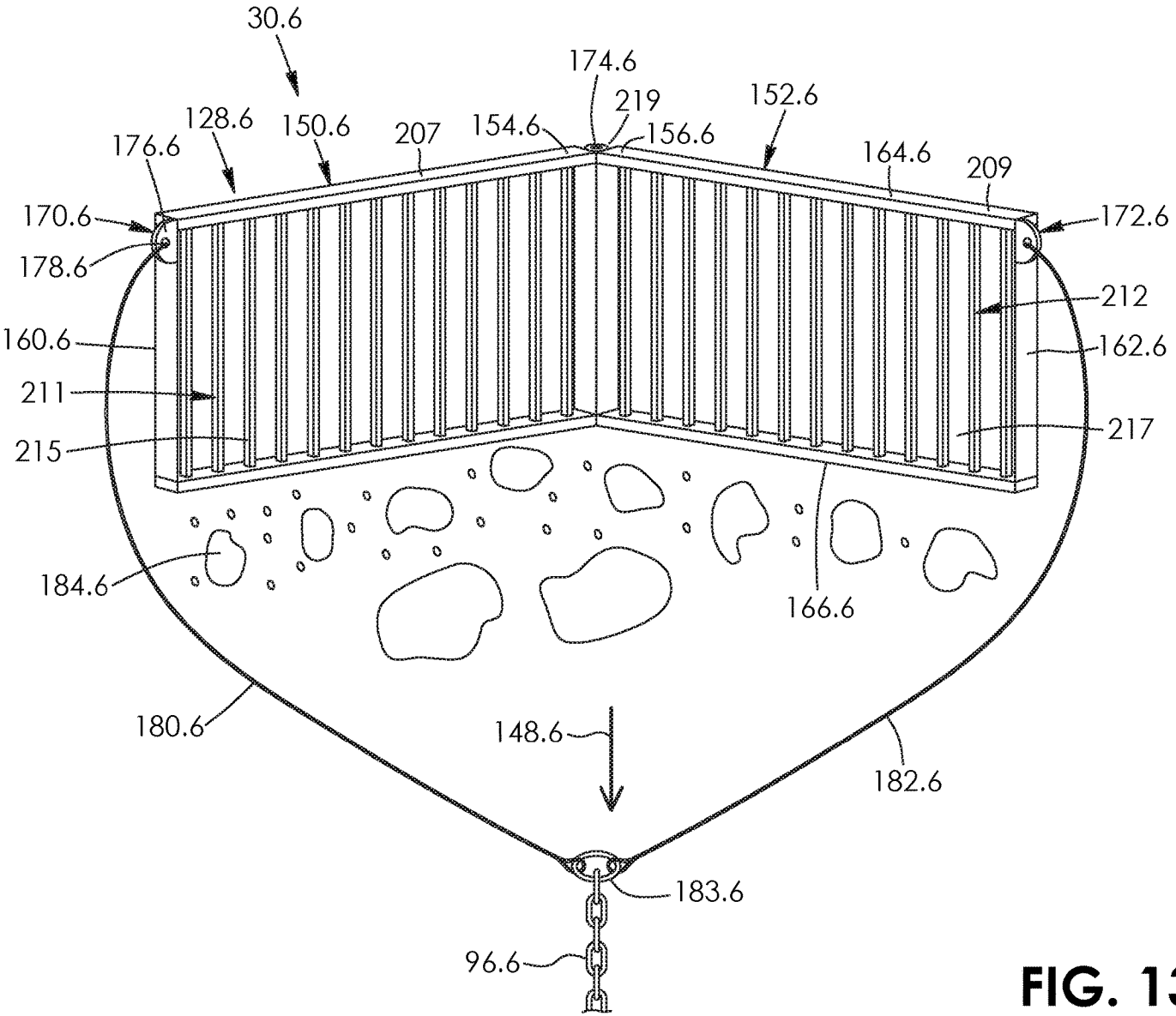
FIG. 13*a* is a perspective view of a material displacement member of a conveyor of a material transfer system according to a seventh aspect, the material displacement member being shown in an open, unfolded mode for collecting material.
Figure 13B:
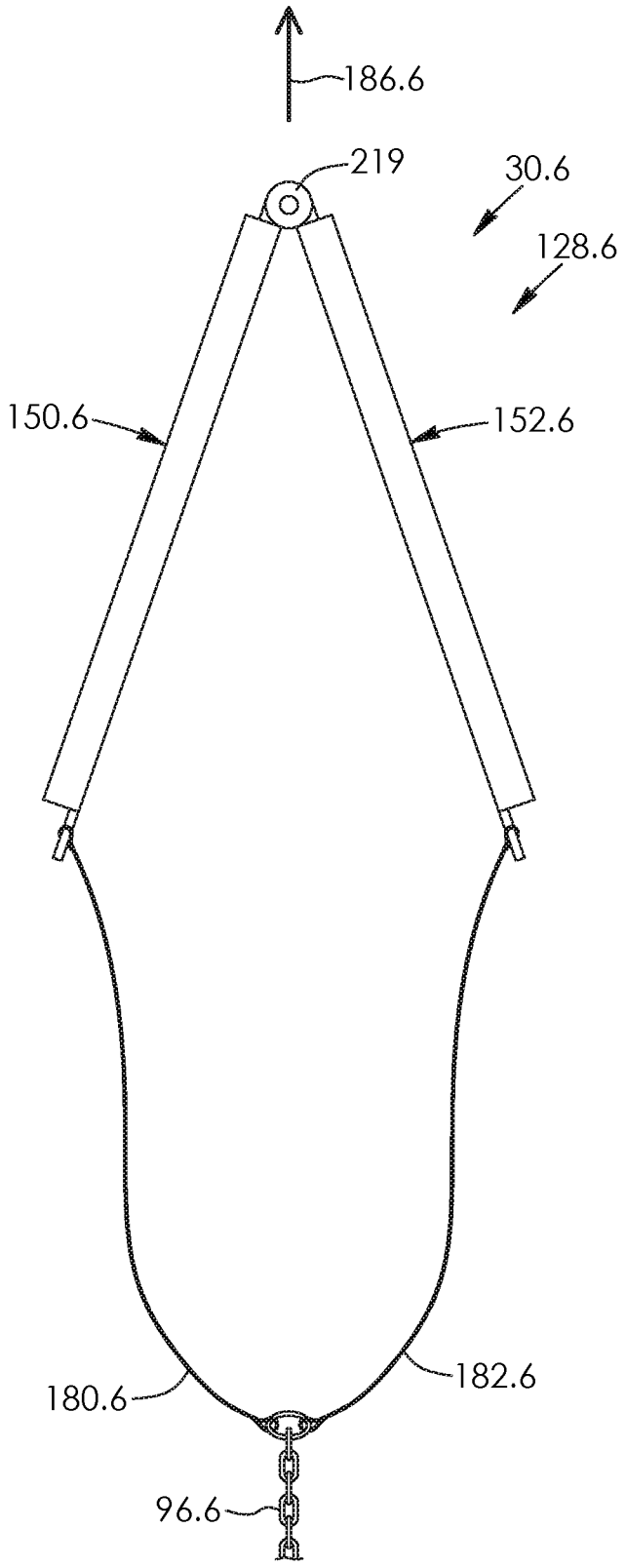
FIG. 13*b* is a perspective view of the material displacement member of FIG. 13*a*, with the material displacement member being shown in a partially closed, partially folded mode in which collection of material is inhibited.

FIGS. 13*a* and 13*b* show a material displacement member 128.6 of a material transfer system 30.6 according to a seventh aspect. Like parts have like numbers and functions as the material displacement members 128 and material transfer system 30 shown in FIGS. 1 to 7 with the addition of decimal extension ".6". System 30.6 is substantially the same as system 30 shown in FIGS. 1 to 7 with the following exceptions.

Each material displacement member 128.6 includes a pair of planar members 150.6 and 152.6 comprising screens 211 and 212 and framing 207 and 209 extending about respective said screens. Each screen includes a plurality of longitudinally extending and laterally spaced-apart, parallel elongate members, in this example bars 215, with a plurality of elongate slots 217 extending between respective adjacent pairs of said bars. The screens 211 and 212 are shaped to enable smaller material to pass therethrough and to retain larger material 184.6.

The planar members 150.6 and 152.6 couple together via a hinge 219 in this embodiment which extends between the top 164.6 and bottom 166.6 of displacement member 128.6. The hinge is located adjacent to inner ends 154.6 and 156.6 of the members.

Outer ends 160.6 and 162.6 of the planar members are pulled via the conveyor 96.6 in collection direction 148.6 when conveying material 184.6 towards the inlet 60 of the siphon 58 seen in FIG. 2*a* for example. Referring back to FIG. 13*b*, the hinge 219 is pulled on by the conveyor when the material displacement member 128.6 is moved in the return direction 186.6, thereby causing the material displacement member to at least partially fold on itself. The material displacement member so folded is thus shaped to inhibit collection of the material 184.6.

Figure 14:
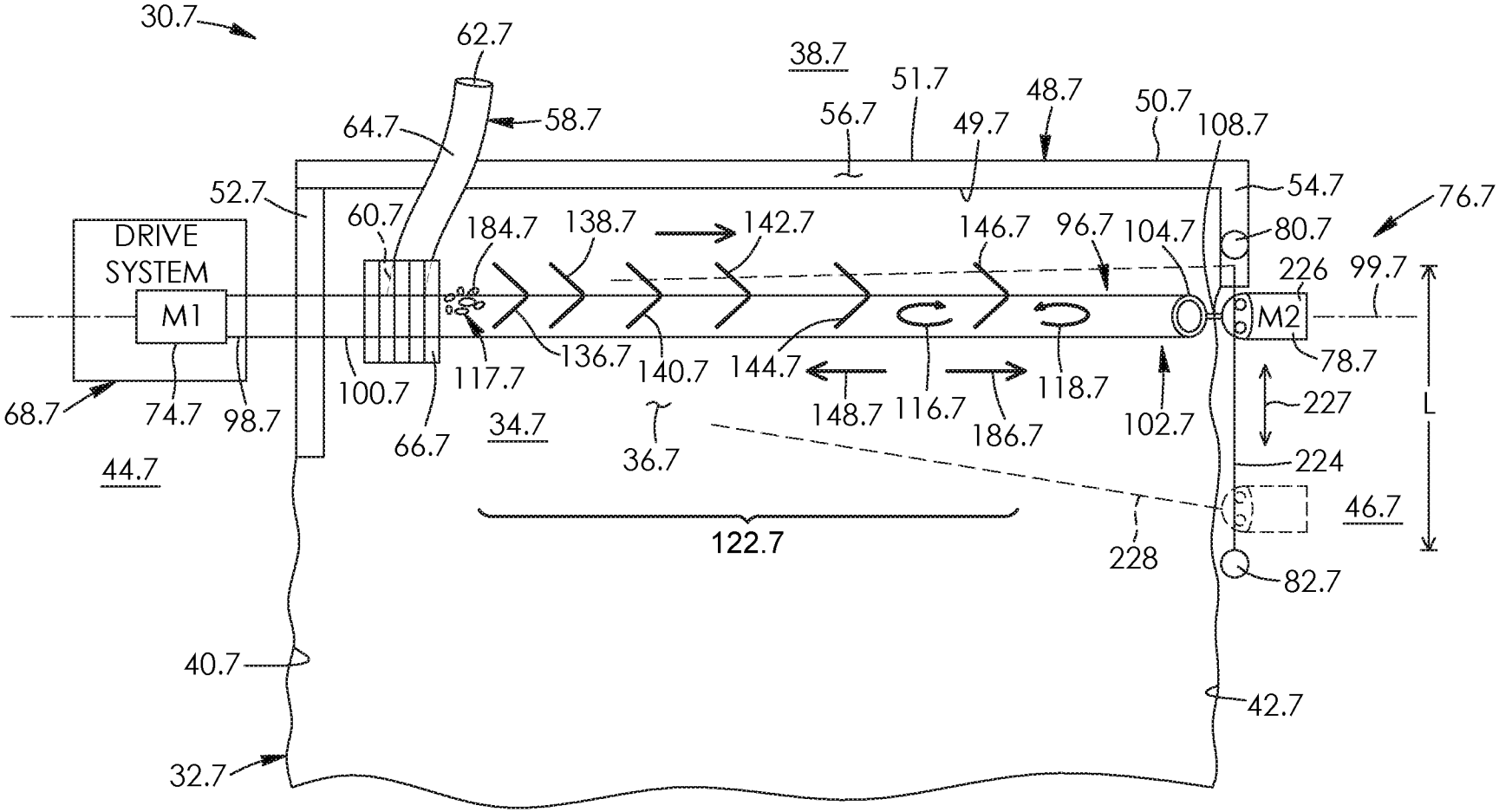
FIG. 14 is a schematic upstream elevation view of a dammed body of water together with a material transfer system according to an eight aspect, the system including a conveyor having first and second longitudinal portions, each including a plurality of material displacement members and with only one of the longitudinal portions being shown.

FIG. 14 shows a material transfer system, in this example a fluvial material transfer system 30.7 according to an eighth aspect. Like parts have like numbers and functions as the material displacement members 128 and fluvial material transfer system 30 shown in FIGS. 1 to 7 with the addition of decimal extension ".7". System 30.7 is substantially the same as system 30 shown in FIGS. 1 to 7 with the following exceptions.

The conveyor position adjustment assembly 76.7 includes a line, in this example a cable 224 which extends between posts 80.7 and 82.7. The conveyor position adjustment assembly further includes a motorized trolley 226 which selectively traverses the cable. The second end portion 102.7 of conveyor 96.7 and pulley 104.7 couple to the motorized trolley via a length-adjustable member, in this example tether 108.7. The trolley is moveable, as shown by arrow of numeral 227, across a length L extending from a first position in which the trolley is adjacent to post 80.7, to a second position shown in stippled lines in which the trolley is adjacent to post 82.7. The conveyor 96.7 may thus gradually remove material 184.7 from an enlarged triangular region 228 of the upstream bottom 36.7 of the river 32.7 in this manner.

Figure 15:
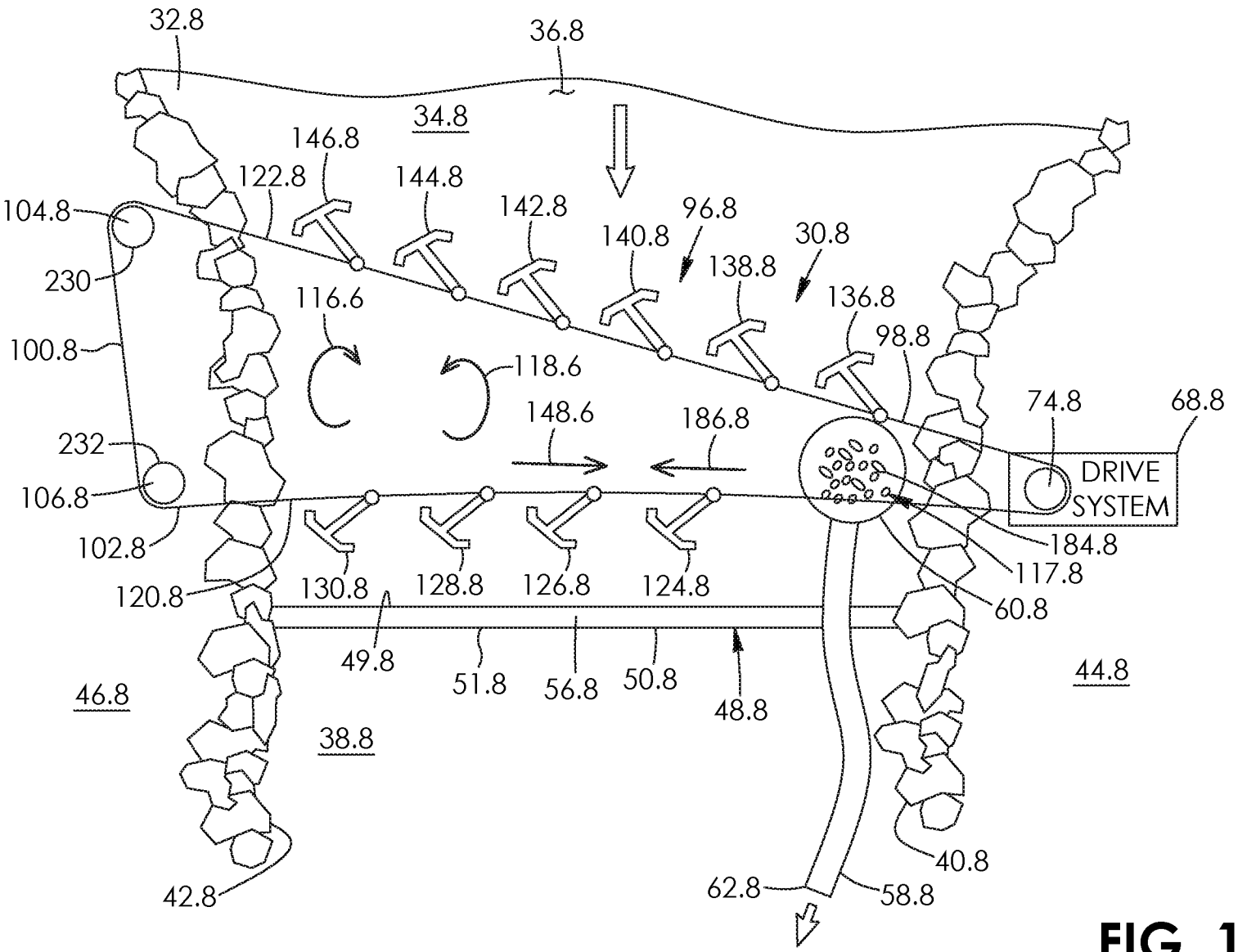
FIG. 15 is a schematic top plan view of a dammed body of water together with a material transfer system according therefor to a ninth aspect, the system including a reciprocating conveyor with a plurality of material displacement members coupled thereto and the system including a siphon.
Figure 16:
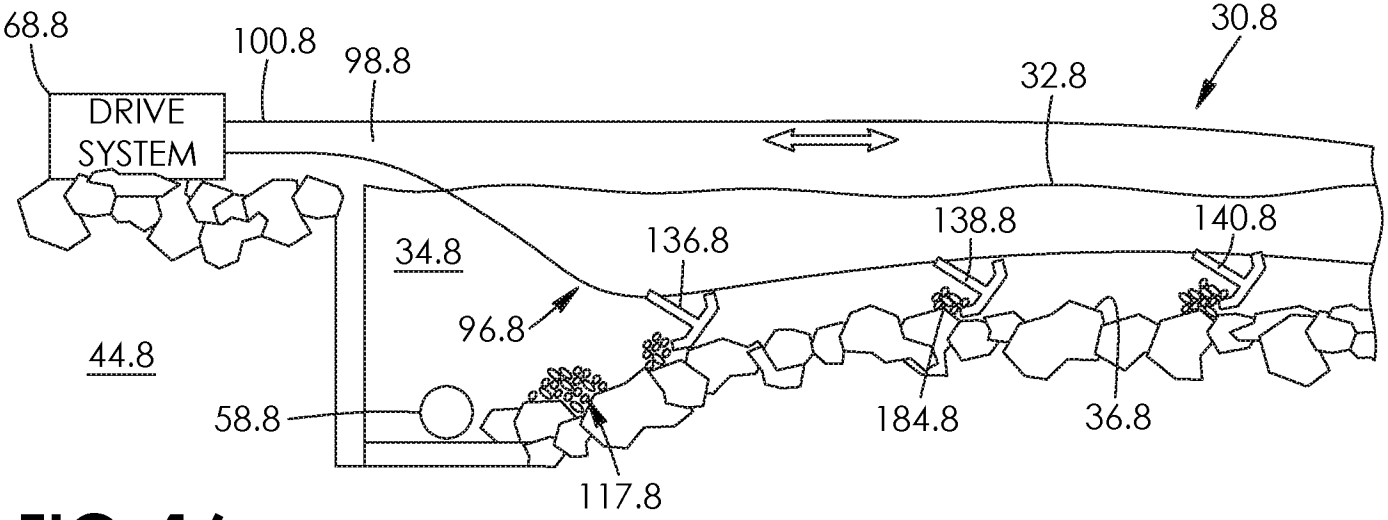
FIG. 16 is a schematic upstream elevation view thereof, with the body of water and system shown in fragment in part.
Figure 17:
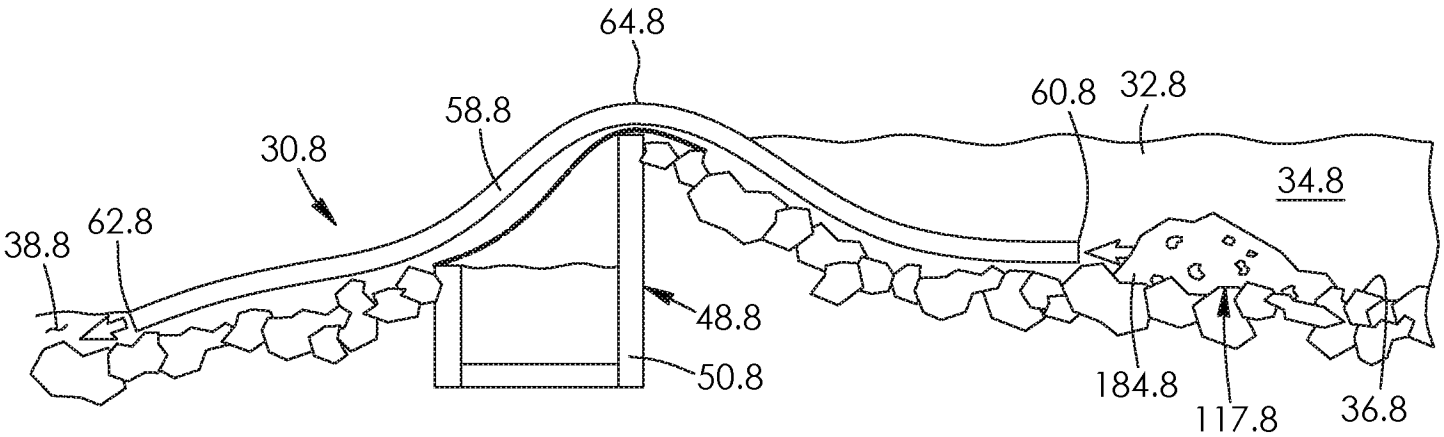
FIG. 17 is a side elevation view of the dammed body of water and the siphon of the system of FIG. 15.
Figure 18:
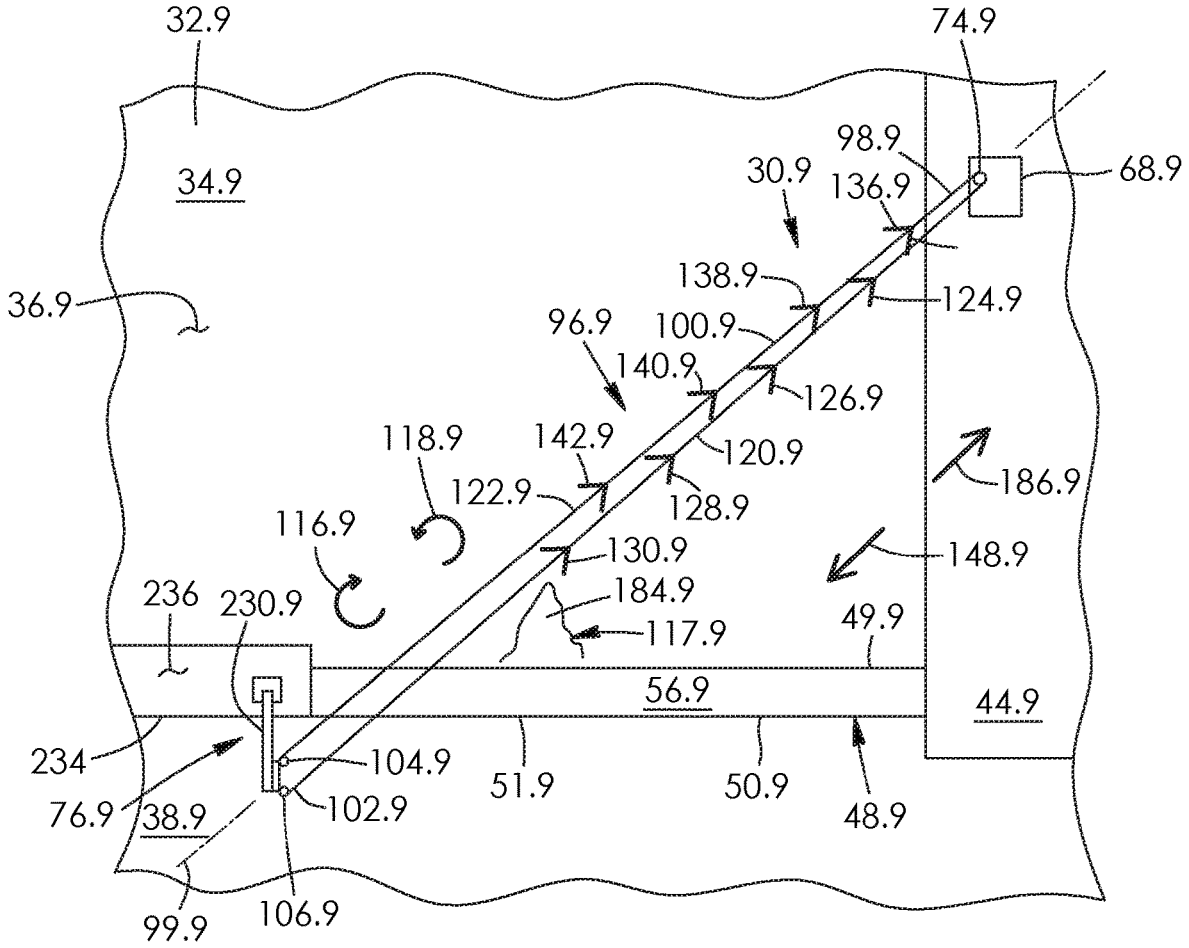
FIG. 18 is a schematic top plan view of a dammed body of water together with a material transfer system therefor according to a tenth aspect, the system including a reciprocating conveyor with a plurality of material displacement members coupled thereto.

FIGS. 15 to 17 show a material transfer system 30.8 according to a ninth aspect. Like parts have like numbers and functions as the material displacement members 128 and fluvial material transfer system 30 shown in FIGS. 1 to 7 with the addition of decimal extension ".8". System 30.8 is substantially the same as system 30 shown in FIGS. 1 to 7 with the following exceptions.

As seen in FIG. 15, system 30.8 includes a pair of spaced-apart mounts, in this example a pair of fixed posts 230 and 232 pile driven into bank 46.8 adjacent to side 42.8 of the river 32.8. Pulleys 104.8 and 106.8 rotatably couple to posts 230 and 232, respectively. Each of the material displacement members 124.8, 126.8, 128.8, 130.8, 136.8, 138.8, 140.8, 142.8, 144.8 and 146.8 is a T-shape in this example in top profile. The material displacement members may also be T-shaped in side profile as shown in FIG. 16.

FIGS. 18 to 21*b* show a material transfer system 30.9 according to a tenth aspect. Like parts have like numbers and functions as the material displacement members 128.8 and material transfer system 30.8 shown in FIGS. 15 to 17 with decimal extension ".9" replacing decimal extension ".8" and being added for numbers not previously having decimal extensions. System 30.9 is substantially the same as system 30.8 shown in FIGS. 15 to 17 with the following exceptions.

Weir 48.9 couples to and extends between bank 44.9 and overflow structure 234. The overflow structure has a top 236 aligned above the top 56.9 of the end wall 50.9 of the weir.

Figure 19:
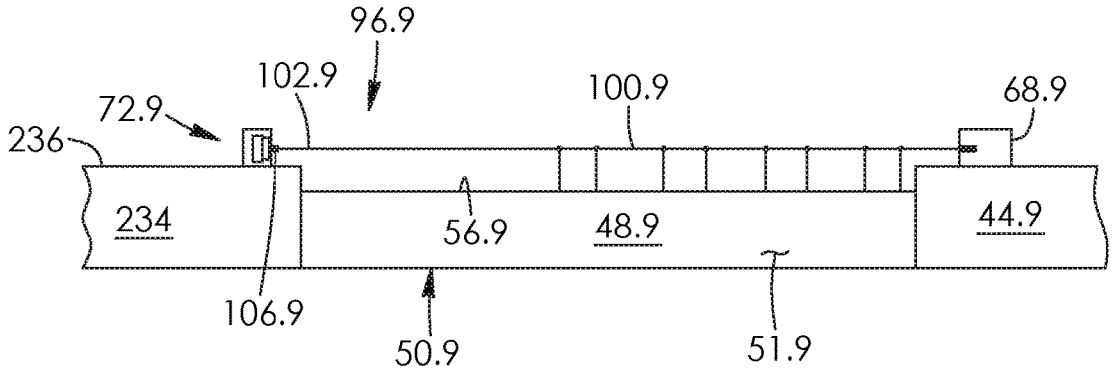
FIG. 19 is a schematic front elevation view thereof, with the body of water and system shown in fragment in part.

System 30.9 includes a conveyor position adjustment assembly 76.9 in the form of a mount, in this example an elongate member 230.9. However, a conveyor position adjustment assembly per se is not strictly required and bolt holes can be drilled anywhere along the elongate member, for example, for rotatably coupling flexible line 100.9 thereto. The elongate member 230.9 couples pulleys 104.9 and 106.9 of conveyor 96.9 to the top 236 of the overflow structure 234 such that the pulleys are positioned adjacent to the downstream portion 38.9 of the body of water, in this example river 32.9. The conveyor is configured to move the material 184.9 to a collection area 117.9 adjacent to an upstream-facing side 49.9 of weir 48.9. Referring to FIG. 19, an overflow of water 238 promotes movement of the material so collected past the downstream-facing side 51.9 of the weir.

Figure 20:
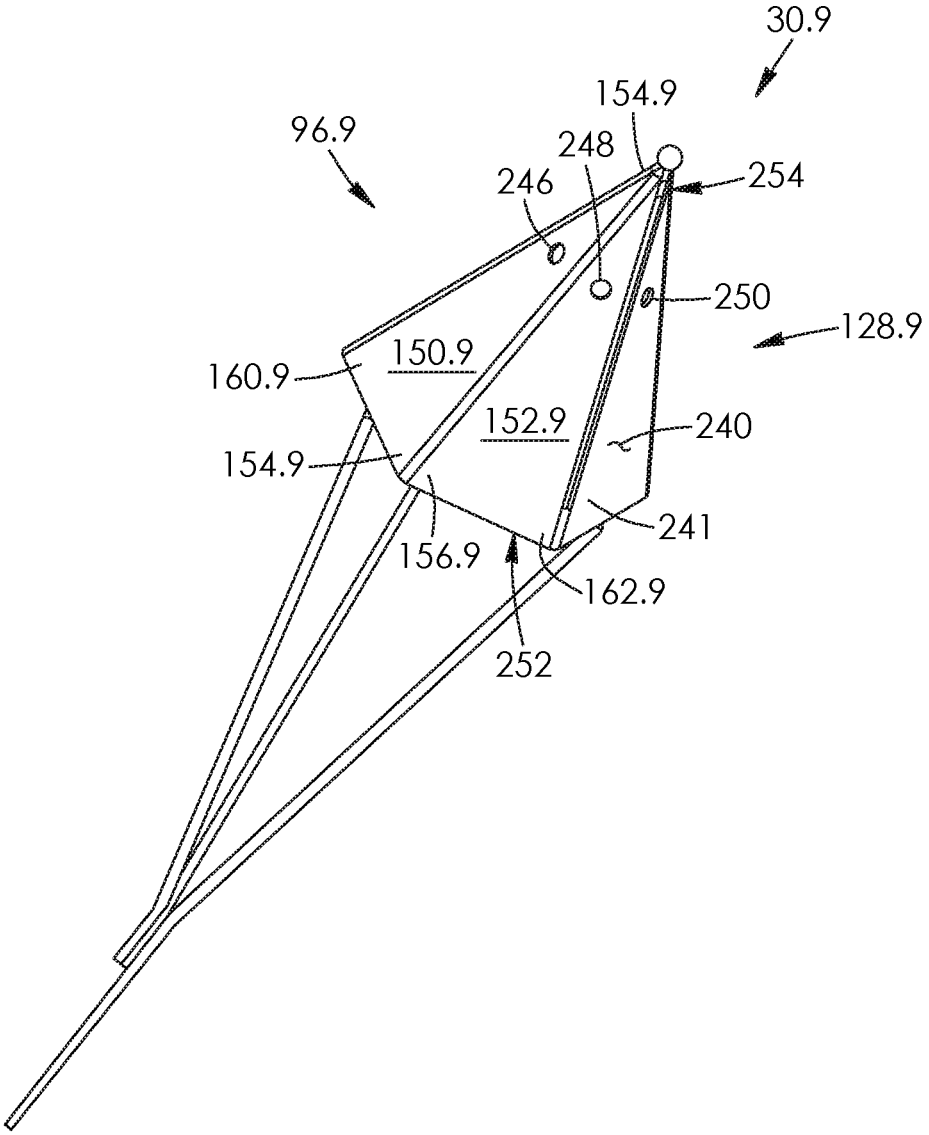
FIG. 20 is a perspective view of one of the material displacement members of the system of FIG. 18.
Figure 21A:
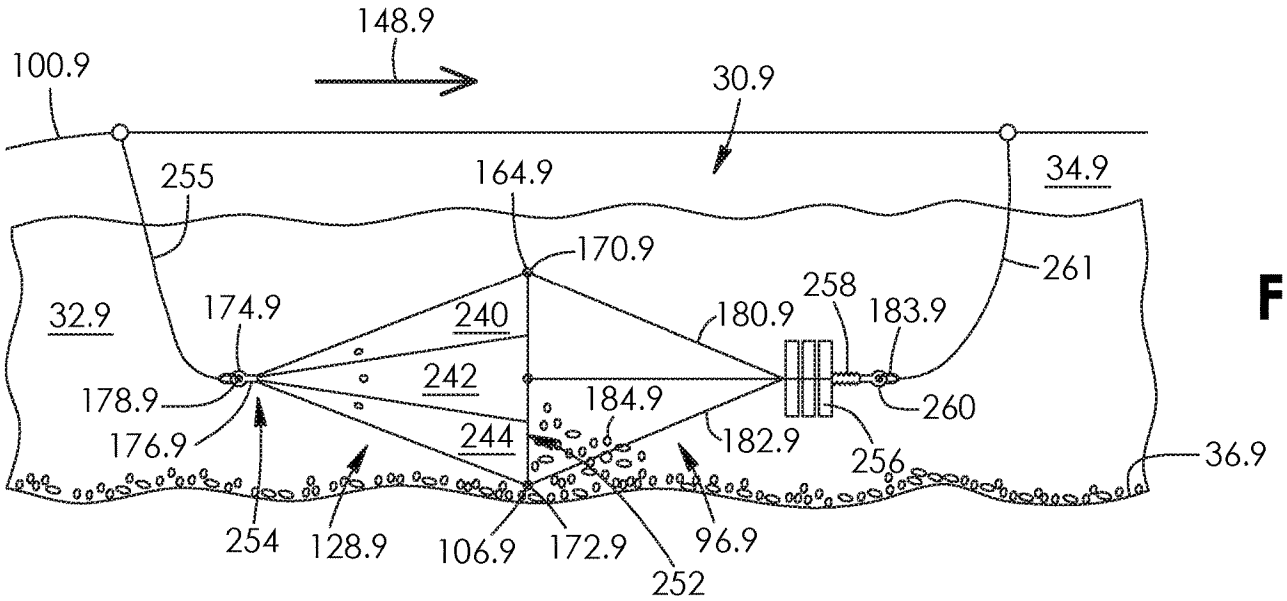
FIG. 21*a* is a side elevation view of the material displacement member of FIG. 20 shown coupled to a continuous line of the conveyor of the system of FIG. 18 and moving in a collection direction along a body of water, the system and body of water shown in fragment.

As seen in FIGS. 20 and 21*a*, each material displacement member 128.9 has a pyramid/cone shape in this example, in this case a multi-sided pyramid, in particular a hexagonal pyramid or cone shape comprised of a plurality of planar members, in this example six metal plates of which are shown plates 150.9, 152.9, 240, 242 and 244. A hexagonal pyramid shape is not strictly required and material displacement members of any variety of multi-sided pyramid and/or cone shapes may be used in other embodiments. Each of the metal plates is an isosceles triangle in shape in this example. Each metal plate 152.9 couples together with adjacent metal plates 150.9 and 240 via sides or ends 156.9 and 154.9 thereof, and ends 162.9 and 241 thereof. As seen in FIG. 20, the metal plates 150.9, 152.9 and 240 have one or more apertures 246, 248 and 250 extending therethrough.

As seen in FIG. 21*a*, each material displacement member 128.9 has an open end 252 shaped to receive material 184.9 when the material displacement member is moved in collection direction 148.9.

Figure 21B:
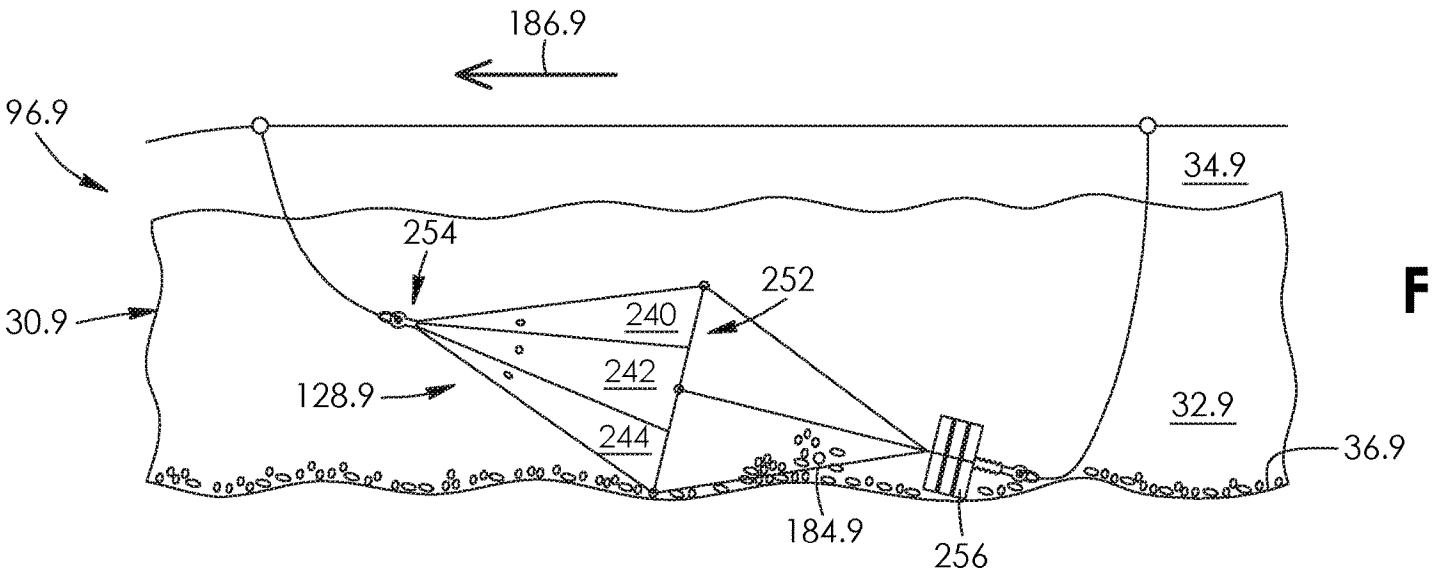
FIG. 21*b* is a side elevation view of the material displacement member of FIG. 21*a* moving in a return direction along the body of water, the system and body of water shown in fragment.

Each material displacement member has a closed tapered end 254 shaped to inhibit collection of material when the material displacement member is moved in return direction 186.9 seen in FIG. 21B. The apertures 246, 248 and 250 seen in FIG. 20 facilitate unloading of material by enabling water to pass therethrough when the material displacement member 128.9 is moved in the return direction, with the water rushing into the material displacement member and helping flush out the material.

As seen in FIG. 21*a*, each material displacement member 128.9 includes one or more weights 256 adjacent to connecting ring 183.9. The weights coupled to the ring via a ready rod 258 and eyelet 260 nut. Each rod converges radially into the center of its material displacement member and is welded thereto. The ready rod 258 is made longer and extends in an axial direction. The weights 256 are stacked onto the ready rod, with the end of the ready rod having an eye nut (not shown), with a nut secured from either side, to hold the weights on and provide an attachment point. Tapered end 254 of the material displacement member 128.9 couples to flexible line 100.9 via connection line or tether 255 and open end 252 of the material displacement member couples to the flexible line via connection line or tether 261 which couples to ring 183.9 in this example. Tethers 255 and 261 are slack at in part, thereby enabling the material displacement members to hang/reach down as the creek bed depth increases.

As seen in FIG. 21*b*, the weights 256 move towards the bottom 36.9 of the body of water, in this example river 32.9, when the material displacement member 128.9 is moving in the return direction 186.9. This promotes the tipping downwards of open 252 of the material displacement member to empty material 184.9 therefrom and the tipping upwards of the tapered end 254 of the material displacement member.

Figure 22:
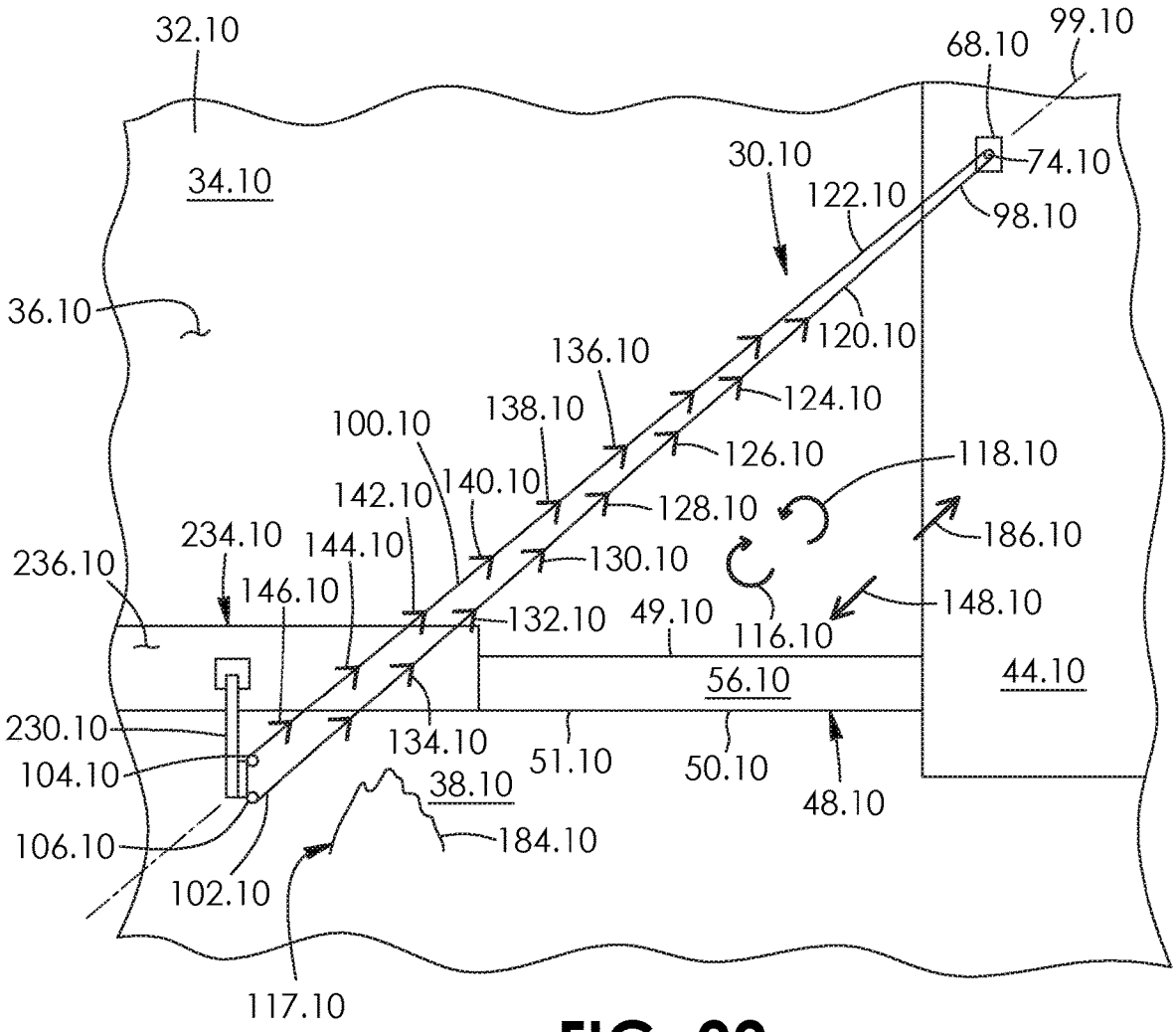
FIG. 22 is a schematic top plan view of a dammed body of water together with a material transfer system therefor according to an eleventh aspect, the system including a reciprocating conveyor with a plurality of material displacement members coupled thereto.
Figure 23:
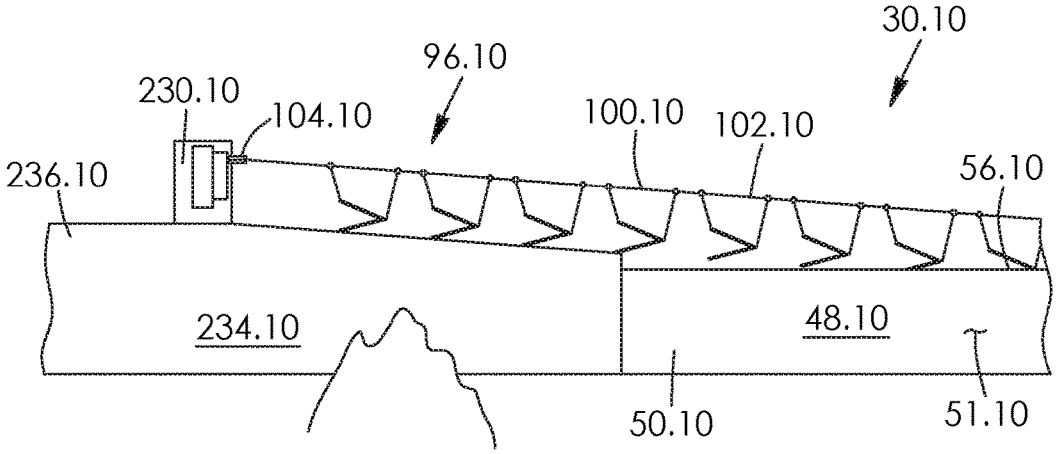
FIG. 23 is a front elevation view thereof, with the system shown in fragment.

FIGS. 22 to 23 show a material transfer system 30.10 according to an eleventh aspect. Like parts have like numbers and functions as the material displacement members 128.9 and material transfer system 30.9 shown in FIGS. 18 to 21 with decimal extension ".10" replacing decimal extension ".9" and being added for numbers not previously having decimal extensions. System 30.10 is substantially the same as system 30.9 shown in FIGS. 18 to 21 with the following exception.

The conveyor 96.10 includes a first end portion 98.10 positioned adjacent to upstream portion 34.10 of a dammed body of water, in this example river 32.10, and a second end portion 102.10 positioned adjacent to a downstream portion 38.10 of the river. As seen in FIG. 22, the conveyor is positioned to convey material 184.10 over top of the overflow structure 234.10 and into collection area 117.10 which is located downstream of the dam, in this example weir 48.10. The material displacement members are thus positioned in part downstream of the weir.

FIGS. 24 to 27 show a material transfer system 30.11 according to a twelfth aspect. Like parts have like numbers and functions as the material displacement members 128.10 and material transfer system 30.10 shown in FIGS. 22 to 23 with decimal extension ".11" replacing decimal extension ".10" and being added for numbers not previously having decimal extensions. System 30.11 is substantially the same as system 30.10 shown in FIGS. 22 to 23 with the following exception.

Figure 27:
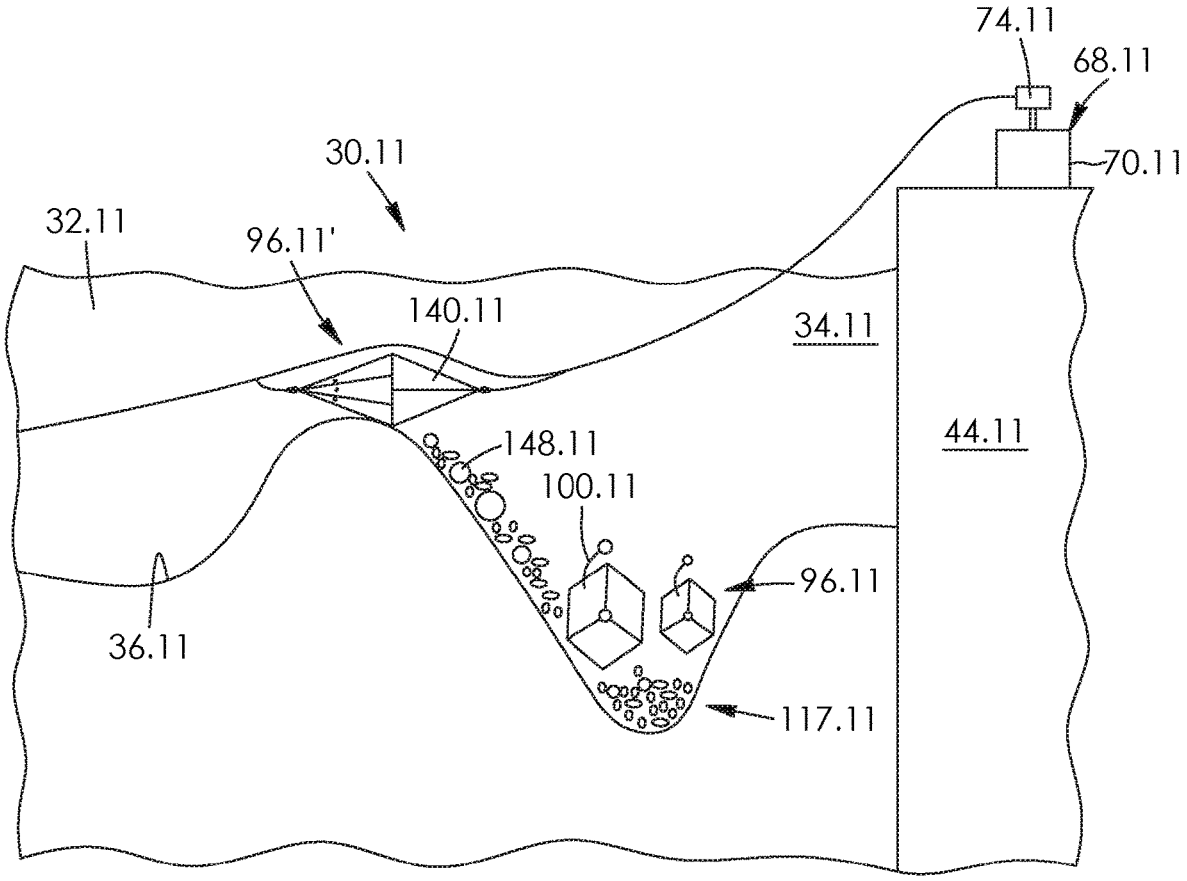
FIG. 27 is a side elevation view of the system of FIG. 24, showing both the first and second reciprocating conveyor of the system of FIG. 24, with the system being shown in fragment.

The material transfer system 30.11 includes a first or cross-stream reciprocating conveyor 96.11 which selectively moves material 184.11 towards a first location or collection area 117.11. The system includes a second or downstream reciprocating conveyor 96.11' which overlaps with the cross-stream reciprocating conveyor. The downstream reciprocating conveyor is substantially the same as the first reciprocating conveyor with like parts having like numbers and the addition of decimal extension '. The longitudinal axis 99.11 of conveyor 96.11 is generally perpendicular to the longitudinal axis 99.11' of conveyor 96.11' in this example. As seen in FIG. 27, the conveyor 96.11' is positioned at least in part below conveyor 96.11 in this example.

Figure 24:
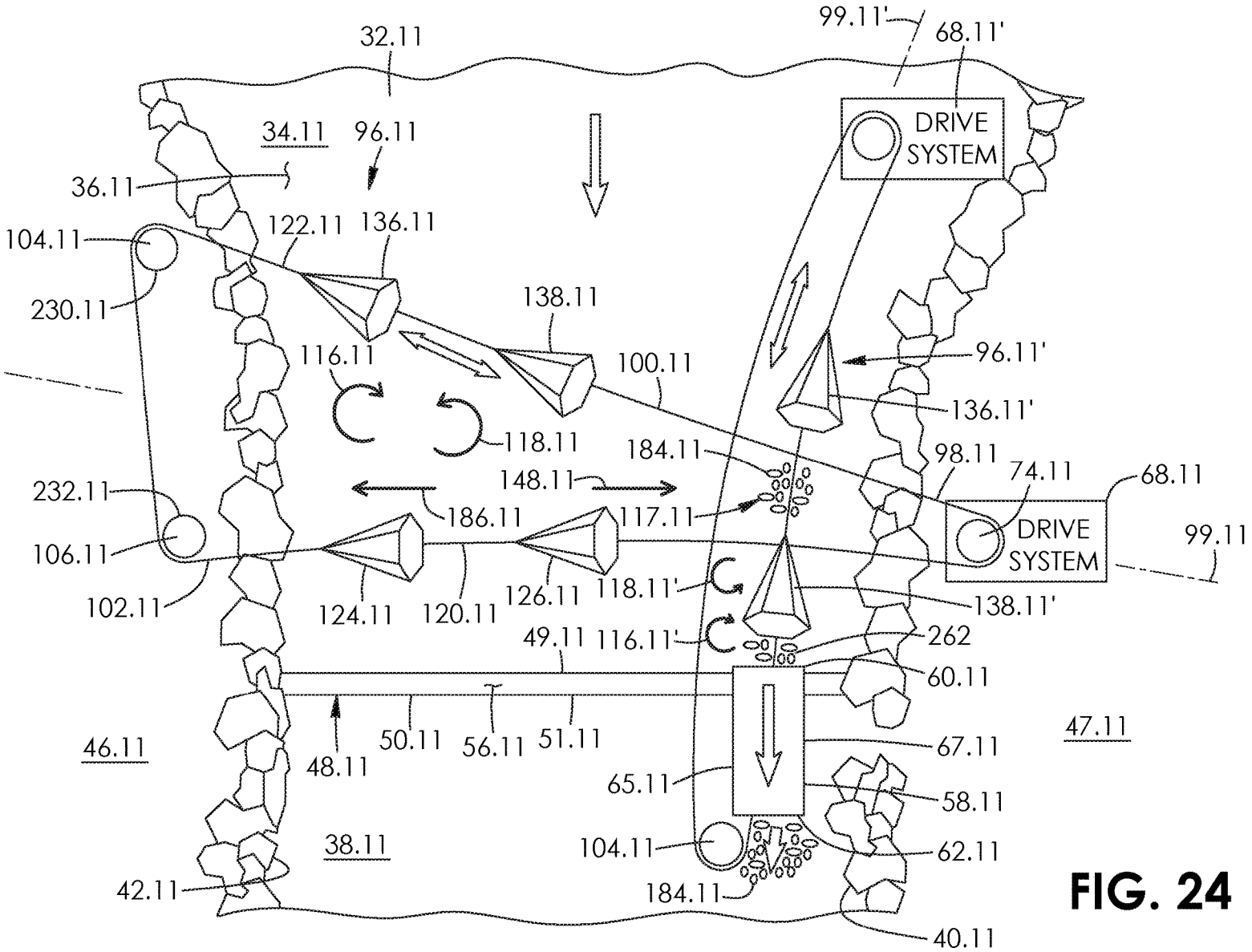
FIG. 24 is a schematic top plan view of a dammed body of water together with a material transfer system therefor according to a twelfth aspect, the system including a first reciprocating conveyor with a plurality of material displacement members coupled thereto and a second reciprocating conveyor with a plurality of material displacement members coupled thereto, the second reciprocating conveyor extending generally perpendicular to the first reciprocating conveyor.
Figure 25:
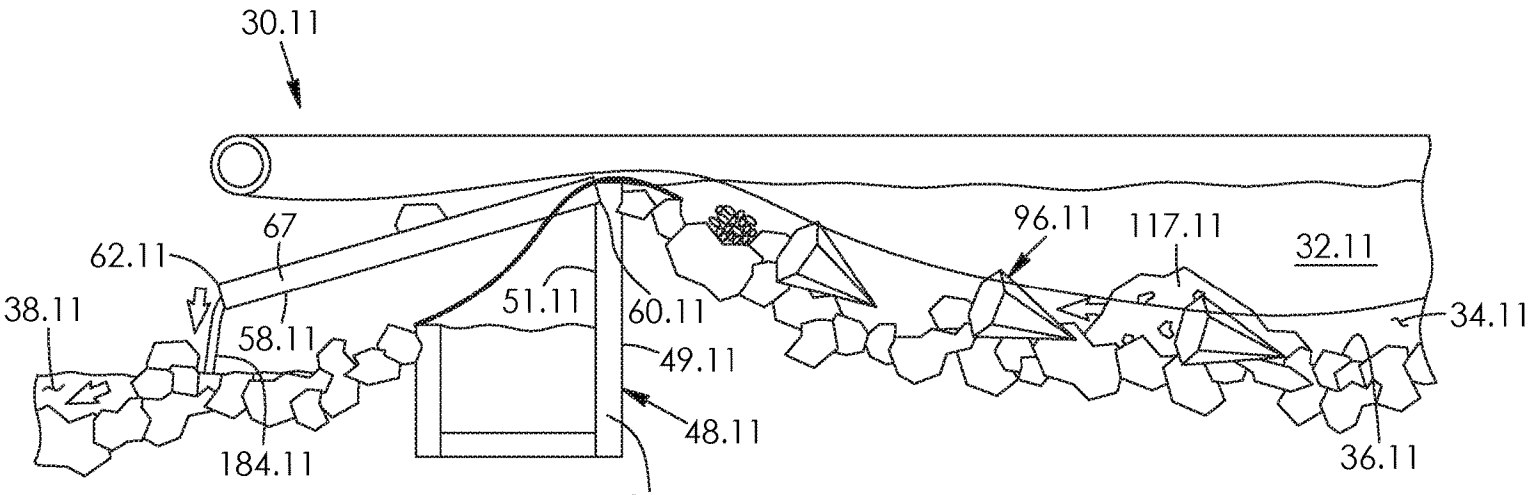
FIG. 25 is a side elevation view thereof showing the second reciprocating conveyor of the system of FIG. 24 together with a chute of the system of FIG. 24, the system being shown in fragment and the first reciprocating conveyor not being shown, and only one longitudinal portion of the second reciprocating conveyor being shown.
Figure 26:
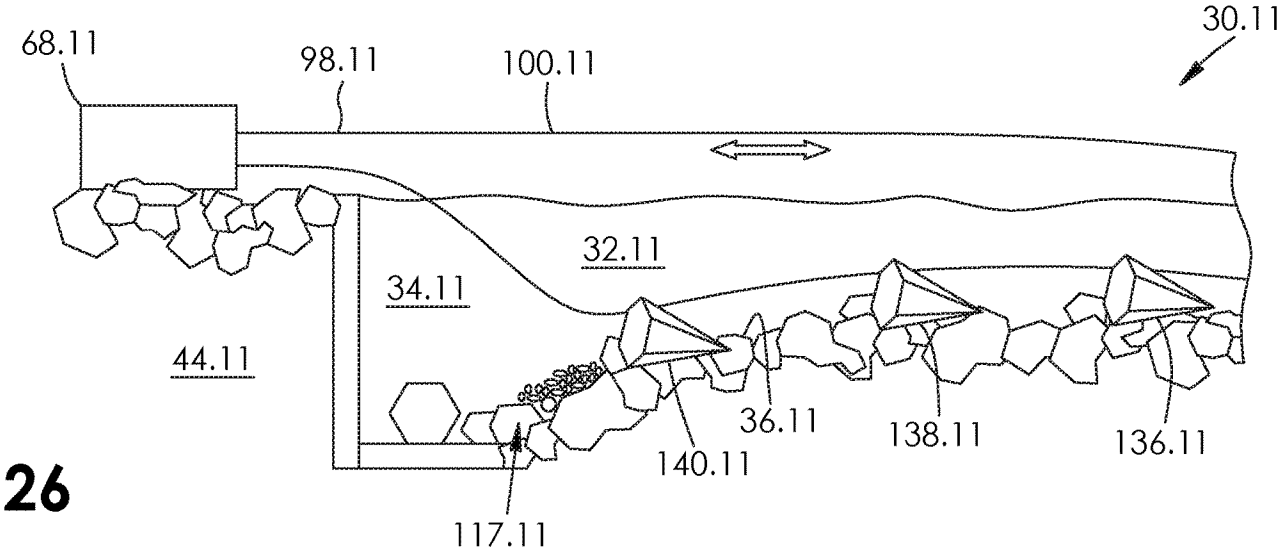
FIG. 26 is an elevation view of the system and body of water of FIG. 24, showing the first reciprocating conveyor of the system of FIG. 24, the system being shown in fragment with only one longitudinal portion of the first reciprocating conveyor being shown, and the second reciprocating conveyor not being shown.

As seen in FIG. 24, the downstream conveyor 96.11' selectively moves material 148.11 from the first collection area 117.11 towards a second location or collection area 262.

The overlapping drive lines of the downstream and cross-stream conveyors are thus stacked. For instance, if one of the motor bases is on higher ground, this will lift part of the drive line, and may act as a mechanism that spaces out the two lines. This separation is not necessarily enough though, so trenches may also be dug and hills built by the two lines to space them out further. This results in the driveline being on top building a hill, so that ends its stroke at the top of a hill and unloads material down the other side of the hill. Next to this hill is a trench, which may be dug out using a lower drive line. The material unloaded at the top of the hill rolls down into this trench to be scooped up by the other stoker line.

The system 30.11 further includes a passageway, in this example a chute 58.11 with a flat bottom in this case. The chute may be referred to as a trough and has an inlet 60.11 adjacent to collection area 262 in an upstream portion 34.11 of a dammed body of water, in this example river 32.11. The chute has an outlet 62.11 for conveying the material 184.11 passing therethrough towards downstream portion 38.11 of the river. The chute 58.1 may comprise a steel sheet with sides 65 and 67 thereof bent upwards in one example. Chutes 58.11 may be particularly suited for sites with larger size material, such as larger rocks.

Figure 28:
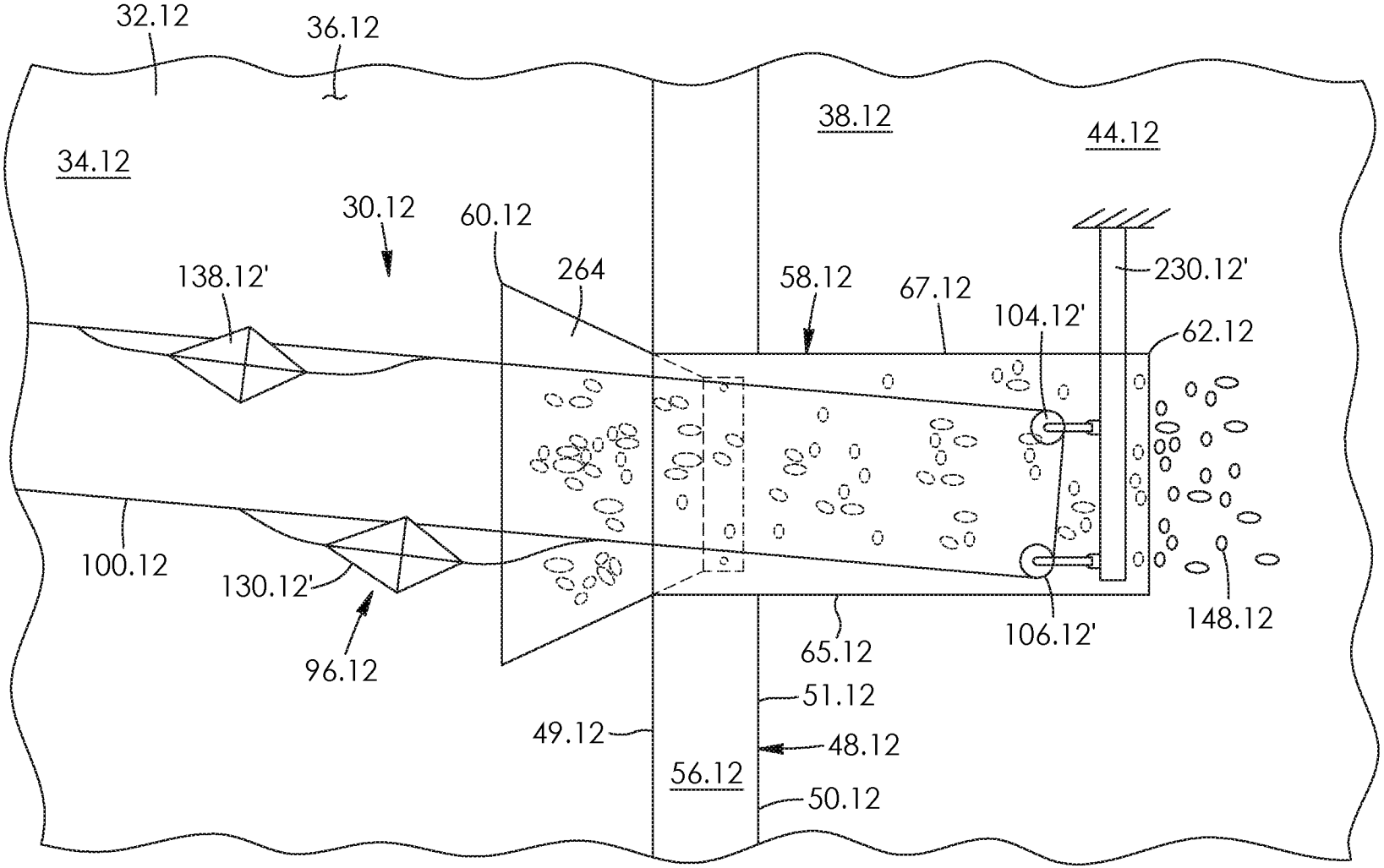
FIG. 28 is a schematic top plan view of a dammed body of water together with a material transfer system therefor according to a thirteenth aspect, the system being shown in fragment.
Figure 29:
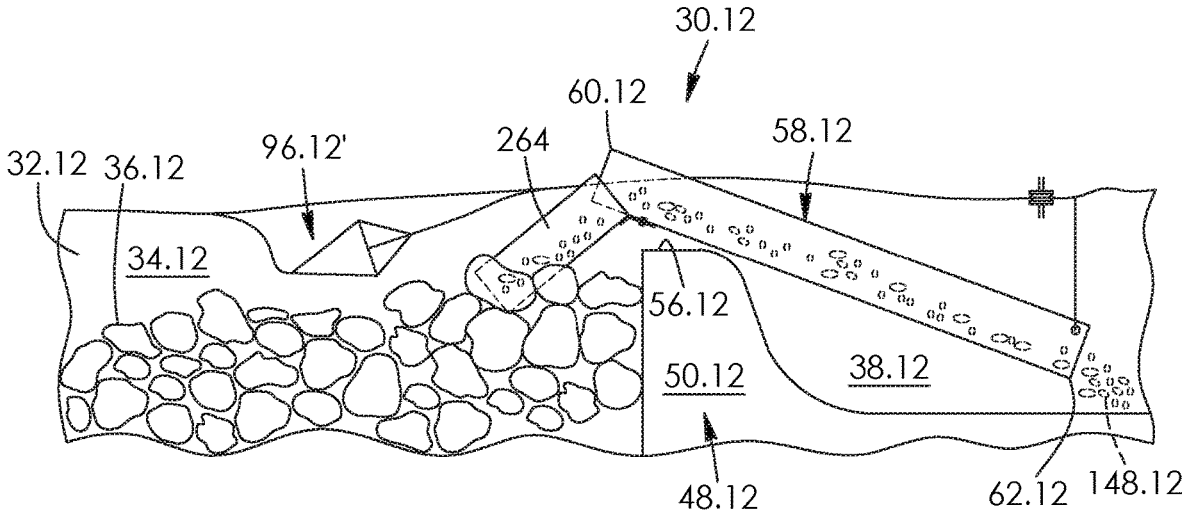
FIG. 29 is a side elevation view thereof.

FIGS. 28 to 29 show a material transfer system 30.12 according to a thirteenth aspect. Like parts have like numbers and functions as the material displacement members 128.12 and material transfer system 30.12 shown in FIGS. 24 to 27 with decimal extension ".12" replacing decimal extension ".11" and being added for numbers not previously having decimal extensions. System 30.12 is substantially the same as system 30.11 shown in FIGS. 24 to 27 with the following exception.

The system 30.12 includes a passageway in this example in the form of a funnel 264 and a chute 58.12 in fluid communication with the funnel. As seen in FIG. 29, the funnel is positioned in the upstream portion 34.12 of the dammed body of water, in this case river 32.12. The funnel angles upwards and tapers towards the top 56.12 of end wall 50.12 of dam, in this example weir 48.12. The funnel 264 is thus angled into the creek bed.

Chute 58.12 extends from the top of the end wall downwards towards the downstream portion 38.12 of the river 32.12. Material 148.12 is received by funnel 264 and conveyed through chute 58.12 thereby. Referring to FIG. 28, the sides 65.12 and 67.12 of the chute 58.1 are sized to cover three quarters of the height of the material displacement members 130.12' and 138.12' in this example so as to inhibit removal of the material displacement members from the chute when therein. Pulleys 104.12' and 106.12' couple to bank 44.11 via a mount, in this example elongate member 230.12'.

Referring to FIG. 28, the chute 58.12 is sufficiently wide so as to accommodate material displacement members 130.12' and 138.12' on both sides of flexible line 100.12.

Figure 30:
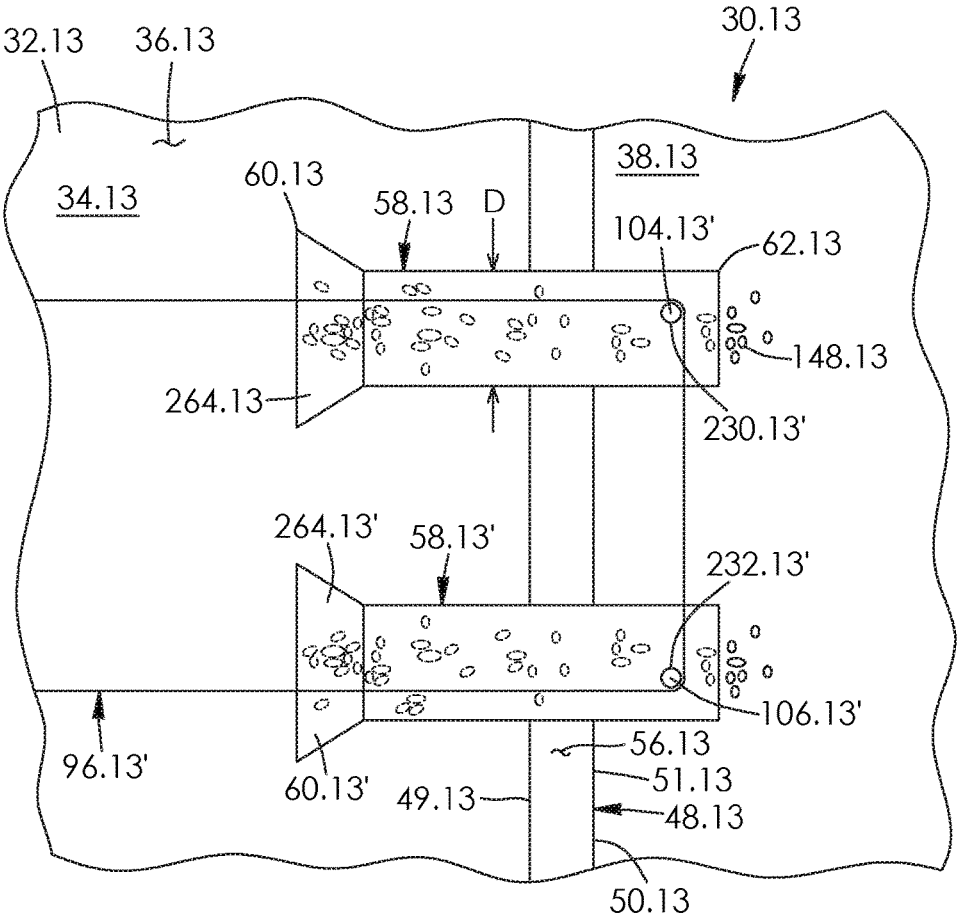
FIG. 30 is a schematic top plan view of a dammed body of water together with a material transfer system therefor according to a fourteenth aspect, the system being shown in fragment.

FIG. 30 shows a material transfer system 30.13 according to a fourteenth aspect. Like parts have like numbers and functions as the material displacement members 128.12 and material transfer system 30.12 shown in FIGS. 28 to 29 with decimal extension ".13" replacing decimal extension ".12" and being added for numbers not previously having decimal extensions. System 30.13 is substantially the same as system 30.12 shown in FIGS. 28 to 29 with the following exception.

The passageway in this example is in the form of a pair of spaced-apart funnels 60.13 and 60.13' coupled to and in fluid communication with a spaced-apart pair of corresponding chutes 58.13 and 58.13'.

Each chute is concave in lateral cross-section in this example and has a diameter D slighter wider than the width each said respective material displacement member.

Pulleys 104.13' and 106.13' couple to mounts, in this example a pair of support structures 230.13' and 232.13' coupled to and extending upwards from respective ones of chutes 58.13 and 58.13'.

Figure 31:
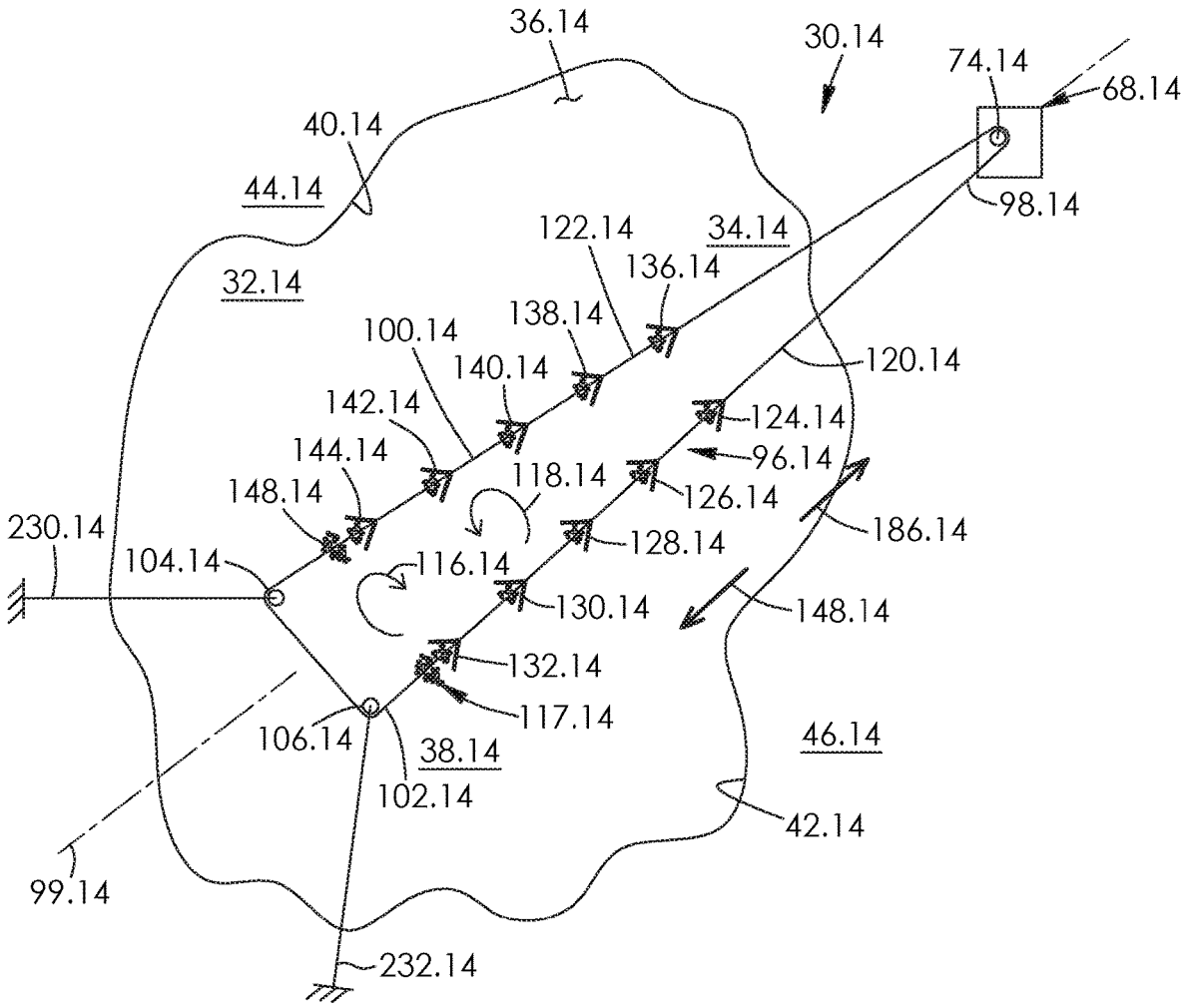
FIG. 31 is a schematic top plan view of a body of water together with a material transfer system therefor according to a fifteenth aspect.

FIG. 31 shows a material transfer system 30.14 according to a fifteenth aspect. Like parts have like numbers and functions as the material displacement members 128.8 and material transfer system 30.8 shown in FIGS. 15 to 17 with decimal extension ".14" replacing decimal extension ".8" and being added for numbers not previously having decimal extensions. System 30.15 is substantially the same as system 30.8 shown in FIGS. 28 to 29 with the following exception.

System 30.14 is shown for moving material 148.14 in a body of water, in this example undammed body of water, in this case a tailing pond 32.14. Pulleys 104.14 and 106.14 couple to banks 44.14 and 46.14 via mounts, in this example length adjustable cables.

It will be appreciated that many variations are possible within the scope of the invention described herein. It will be understood by someone skilled in the art that many of the details provided above are by way of example only and are not intended to limit the scope of the invention which is to be determined with reference to at least the following claims.

What is claimed is:

1. A material transfer system for moving material in a body of water, the system comprising:

a reciprocating conveyor having first and second longitudinal portions and being configured to move in a first rotational direction and a second rotational direction opposite the first rotational direction;

one or more material displacement members coupled to the first longitudinal portion of the conveyor, shaped to promote collection of the material therein when the conveyor moves in the first rotational direction and shaped to inhibit collection of the material therein when the conveyor moves in the second rotational direction; and one or more material displacement members coupled to the second longitudinal portion of the conveyor, shaped to inhibit collection of the material when the conveyor moves in the first rotational direction and shaped to promote collection of the material therein when the conveyor moves in the second rotational direction.

2. The system as claimed in claim 1, wherein the material displacement members convey the material to a collection area, and wherein each said longitudinal portion of the conveyor comprises a plurality of said material displacement members with the material displacement members thereof located further away from the collection area being smaller than the material displacement members thereof located closer to the collection area.

3. The system as claimed in claim 1, wherein the material displacement members which convey the material to a collection area, and wherein each said longitudinal portion of the conveyor comprises a plurality of said material displacement members with the material displacement members thereof located closer to the collection area being closer to each other than the material displacement members thereof located further away from the collection area.

4. The system as claimed in claim 1, wherein each said longitudinal portion of the conveyor comprises a plurality of said material displacement members with movement ranges of adjacent said material displacement members thereof overlapping.

5. The system as claimed in claim 1, further including a conveyor position adjustment assembly that selectively rotates the conveyor about an end thereof.

6. The system as claimed in claim 1 wherein each said material displacement member is configured to extend along and adjacent to a bottom of an open said body of water.

7. The system as claimed in claim 1 wherein the conveyor includes a first end portion positioned adjacent to an upstream portion of a dammed said body of water and a second end portion positioned adjacent to a downstream portion of the dammed said body of water.

8. The system as claimed in claim 1 wherein the conveyor moves the material towards a collection area, and wherein the system further includes a passageway having an inlet adjacent to the collection area in an upstream portion of a dammed said body of water and having an outlet for conveying the material towards a downstream portion of the dammed said body of water, the passageway comprising one or more of:

a) a conduit;

b) a siphon;

c) a chute with a flat bottom;

d) a chute that is concave in lateral cross-section;

e) a pair of spaced-apart chutes; and f) a funnel in the upstream portion of the dammed said body of water which angles upwards towards a top of a dam and a chute in fluid communication with the funnel and which angles downwards towards the downstream portion of the dammed said body of water.

9. The system as claimed in claim 1, comprising a siphon in fluid communication with an upstream portion of the body of water, the conveyor being configured to convey upstream said material of the body of water towards the siphon.

10. The system as claimed in claim 9, wherein the siphon has an inlet in fluid communication with the upstream portion of the body of water and wherein the siphon has an outlet positioned to convey material passing through the siphon to a downstream portion of the body of water.

11. The system as claimed in claim 1, comprising:

a first said reciprocating conveyor which selectively moves said material towards a first location; and a second said reciprocating conveyor which overlaps or is adjacent at least in part with the first said reciprocating conveyor and which selectively moves said material from said first location towards a second location.

12. The system as claimed in claim 11 wherein the first said reciprocating conveyor has a longitudinal axis, the second said reciprocating conveyor has a longitudinal axis, and the longitudinal axis of the first said reciprocating conveyor is perpendicular to the longitudinal axis of the second said reciprocating conveyor.

13. The system as claimed in claim 11 wherein the second said reciprocating conveyor is positioned at least in part below the first said reciprocating conveyor.

14. The system as claimed in claim 11 wherein the first said reciprocating conveyor is configured to be a cross-stream said conveyor and the second said reciprocating conveyor is configured to be a downstream said conveyor.

15. The system as claimed in claim 1, wherein three or more longitudinally spaced-apart said material displacement members are coupled to the conveyor and via which the conveyor promotes movement of the material.

16. The system as claimed in claim 1, wherein the longitudinal portions of the conveyor are configured to move in opposite directions.

17. The system as claimed in claim 1, wherein the material displacement members are configured incrementally move the material.

18. The system as claimed in claim 1, wherein the conveyor includes a loop-shaped carrying medium to which the reciprocating drive mechanism couples to cause the conveyor to move in the reciprocating manner.

19. The system as claimed in claim 18 wherein each said material displacement member couples to the flexible line via a connection line.

20. The system as claimed in claim 18, wherein the conveyor includes a first end portion with a first pulley adjacent thereto and a second end portion with a second pulley adjacent thereto, and wherein the second end portion of the conveyor is selectively moveable relative to the first end portion of the conveyor.

21. The system as claimed in claim 1, wherein the body of water is a river.

22. Use of the system as claimed in claim 1 to gradually remove fluvial said material built up along a bottom of a river.

23. The use as claimed in claim 1 to inhibit fluvial material build-up upstream of a weir.

24. A material transfer system for moving material in a body of water, the system comprising:

a reciprocating conveyor which selectively moves in a first rotational direction of movement and a second rotational direction of movement opposite the first rotational direction of movement, the conveyor being configured to promote movement of said material in said first rotational direction and inhibit movement of said material in said second rotational direction, wherein the conveyor includes first and second longitudinal portions, each having one or more longitudinally spaced-apart material displacement members coupled thereto, wherein the one or more material displacement members of the first longitudinal portion of the conveyor are shaped to promote collection of the material therein when the conveyor moves in the first rotational direction and are shaped to inhibit collection of the material therein when the conveyor moves in the second rotational direction, and wherein the one or more material displacement members of the second longitudinal portion of the conveyor are shaped to inhibit collection of the material when the conveyor moves in the first rotational direction and are shaped to promote collection of the material therein when the conveyor moves in the second rotational direction; and a reciprocating drive mechanism to which the conveyor is operatively connected, the conveyor moving in a reciprocating manner via the reciprocating drive mechanism.

25. A material transfer system for moving material in a body of water, the system comprising:

a reciprocating conveyor which selectively moves in a first direction of movement and a second direction of movement opposite the first direction of movement, the conveyor being configured to promote movement of said material in said first direction and inhibit movement of said material in said second direction, wherein the conveyor includes one or more material displacement members, each promoting movement of the material in a first said direction and inhibiting movement of the material in a second said direction; and a reciprocating drive mechanism to which the conveyor is operatively connected, the conveyor moving in a reciprocating manner via the reciprocating drive mechanism;

wherein a first said material displacement member when moving in the first said direction, incrementally promotes collection of and movement of a portion of material adjacent thereto towards one or more of a collection area and a second said material displacement member;

wherein the second said material displacement member when moving in the second said direction, moves towards said portion of material incrementally moved forward by the first said material displacement member; and wherein the second said material displacement member when moving in the first said direction thereafter, incrementally promotes collection of and movement of said portion of material towards one or more of the collection area and a third said material displacement member.

* * * * *